US009347660B1

(12) United States Patent
Zadro

(10) Patent No.: US 9,347,660 B1
(45) Date of Patent: May 24, 2016

(54) DUAL MAGNIFICATION ILLUMINATED MULTI-SPECTRUM TABLE MIRROR

(71) Applicant: Zlatko Zadro, Huntington Beach, CA (US)

(72) Inventor: Zlatko Zadro, Huntington Beach, CA (US)

( * ) Notice: Subject to any disclaimer, the term of this patent is extended or adjusted under 35 U.S.C. 154(b) by 232 days.

(21) Appl. No.: 14/082,177

(22) Filed: Nov. 17, 2013

(51) Int. Cl.
*F21V 33/00* (2006.01)
*A45D 42/10* (2006.01)
*H01R 39/12* (2006.01)

(52) U.S. Cl.
CPC ..... *F21V 33/004* (2013.01)

(58) Field of Classification Search
CPC ..... F21V 33/004; F21W 2131/302; A45D 42/10; H01R 35/04; H01R 39/12
See application file for complete search history.

(56) References Cited

U.S. PATENT DOCUMENTS 296,355 A * 4/1884 Ritchie ..... H01R 35/04 439/6
876,039 A * 1/1908 Burrell ..... A45D 42/10 362/144
1,786,420 A * 12/1930 Braly ..... A45D 42/10 362/135
1,837,890 A * 12/1931 Baker ..... H01R 39/643 439/18
2,520,739 A * 8/1950 Shaw ..... H01R 13/20 403/329
2,702,376 A * 2/1955 Brush ..... H03F 3/54 439/252
3,193,636 A * 7/1965 Daniels ..... H01R 24/58 191/12 R
4,992,704 A * 2/1991 Stinson ..... H05B 33/0821 313/303
5,425,645 A * 6/1995 Skovdal ..... H01R 39/64 439/13
5,997,149 A * 12/1999 Chu ..... A45D 42/10 362/142
6,273,585 B1 * 8/2001 Wu ..... F21V 21/30 362/135
6,945,805 B1 * 9/2005 Bollinger ..... H01R 13/6276 439/348
8,162,502 B1 * 4/2012 Zadro ..... A45D 42/10 362/141

FOREIGN PATENT DOCUMENTS

WO WO 2011008779 A1 * 1/2011 ..... A45D 42/10

* cited by examiner

*Primary Examiner* — Ismael Negron
(74) *Attorney, Agent, or Firm* — William L. Chapin

(57) ABSTRACT

A mirror includes a frame holding therein back-to-back mirror plates having different magnification factors, e.g. 1× and 5×, each plate having a central reflective imaging area and a concentric light transmissive window. Continuously rotatable bushings supporting the frame between opposed arms of a yoke enable interchangeable orientation of 1× and 5× mirror plates in a forward-facing use position. A printed circuit board holding a circular ring of alternating yellow and white light emitting diodes (LED's) within the frame between the windows receives electrical power from a power supply in the base of the mirror via novel continuously rotatable two-conductor and single-conductor electrical connectors located in opposite sides of the frame and a coaxial cable and a single conductor wire disposed through opposed yoke-arm bushings, enabling energization of yellow, white, or both type LED's to thus illuminate a face or other object near the windows at three different selectable color temperatures.

33 Claims, 15 Drawing Sheets

DUAL MAGNIFICATION ILLUMINATED MULTI-SPECTRUM TABLE MIRROR

BACKGROUND OF THE INVENTION

A. Field of the Invention

The present invention relates to mirrors of the type used by people to facilitate performance of personal appearance related functions such as applying cosmetics and the like. More particularly, the invention relates to a versatile free-standing mirror which includes a base for supporting the mirror on a horizontal surface such as that of a table top, and a frame containing back-to-back mirror plates of different magnification factors, the frame being pivotably mounted to the base by a continuously rotatable joint and containing an internal illumination source that is effective in illuminating object fields in front of both mirror plates with light which has a color temperature that is adjustable by the user.

B. Description of Background Art

Certain aspects of a person's appearance are best attended to by observing a person's image in a relatively large "wide angle" mirror, which has a flat reflective surface that provides a unity or "1×" magnification. Mirrors of this type include full length wall mirrors, dresser mirrors, and bathroom mirrors mounted on a wall or cabinet. Other grooming functions such as shaving, applying cosmetics and the like are generally more easily performed while viewing a larger image of one's face, which can be obtained by positioning the face closer to a flat, non-magnifying mirror. In some circumstances, however, it is not convenient to position one's face sufficiently close to an existing flat mirror to provide an image which is sufficiently large to enable a desired personal grooming task to be easily performed. In such situations, it would be desirable to have available a magnifying mirror, i.e., a mirror having a magnification factor greater than one.

Since counter space available in locations such as bathrooms is often at a premium, it would also be desirable to have available a portable magnifying mirror which may be readily placed in a free-standing disposition on a horizontal surface, such as that of an existing table top or vanity top. Additionally, since different mirror magnifications are useful for performing different aspects of a person's grooming, it would be desirable to have a portable free-standing mirror, which had at least two different, selectable magnifications.

A wide variety of magnifying and non-magnifying mirrors are available for personal use. However, since a person's vision generally degrades with age, there is an accompanying need for a mirror of selectable magnification which can supplement existing larger mirrors to enable a person to see image details required to perform personal care functions.

In response to a perceived need for mirrors having different magnification factors, a variety of mirrors have been disclosed which can provide more than just one magnification factor, e.g., 1× and 5×. Examples of such mirrors include the present inventor's U.S. design Pat. No. D532,981 for a Dual Magnification Table Mirror, U.S. Pat. No. 7,341,356 for a Dual Magnification Vanity Mirror Adjustable In Height And Orientation, and U.S. Pat. No. 6,854,852 for a Dual Magnification Reversible Spot Mirror Releasably Attachable To Flat Surfaces.

Dual magnification mirrors of the type described above provide a satisfactory solution to the requirement for personal mirrors having selectable magnifications. However, there are applications, such as in dimly lit rooms, where it would be desirable to have a mirror which includes an illumination source for illuminating an object such as a person's face positioned in front of the mirror. Thus, there have been disclosed a variety of mirrors which contain an illumination source, including the present inventor's U.S. Pat. No. 6,158,877 for a Magnifying Mirror Having Focused Annular Illuminator and U.S. Pat. No. 7,090,378 for a Dual Magnification Folding Travel Mirror With Annular Illuminator.

The illuminated mirrors disclosed in the foregoing patents have proved satisfactory for their intended purposes. However, there remained a need for a dual magnification mirror which has back-to-back mirrors mounted in a frame that includes an illumination source which provides substantially equal illumination of object fields located in front of either mirror, is rotatable continuously without the possibility of twisting electrical wires used to carry electrical current to the illumination source, and which is powered by batteries contained within the base of the mirror and thus not requiring a power cord for connection to power mains. In response to that perceived need, the present inventor developed and disclosed in U.S. Pat. Nos. 8,162,592 and 8,356,908 continuously rotatable dual magnification mirrors that have internal illuminators.

Each of the above-identified mirrors provided a satisfactory means for aiding in performance of various personal appearance grooming functions. However, the present inventor has become aware of an additional problem related to personal appearance maintenance tasks which is encountered by women and other people who have acute color vision and fashion consciousness. That problem, sometimes referred to as color metamerism, results from the fact that perceived colors of objects and surfaces as diverse as clothing and skin complexion can very substantially in different ambient lighting conditions. For example, coordination of colors of different articles of clothing, facial makeup, and the like which might provide a satisfactory appearance in ambient lighting typical of an office environment having a color temperature of about 6400 K may not look as well in ambient illumination having a different color temperature, as for example evening light having a color temperature of approximately 4000 K. At lower color temperatures, the spectrum of the light is shifted to longer wavelength, redder values which change the visually perceived appearance of the hue and saturation of different items of clothing, lipstick and the like, and relative color differences between different items.

Similarly, the relative appearance of colors of cosmetics and clothing that have been coordinated in ambient light having a color temperature approximating that of an office environment an change substantially in daylight.

For the foregoing reasons, it would be desirable to provide a multi-spectrum mirror which could illuminate objects in front of the mirror with light having various color temperatures selectable by the user, to thus simulate various types of ambient illumination, such as daylight, office and evening. Providing such a mufti-spectrum mirror was a motivating factor in the development of the present invention.

OBJECTS OF THE INVENTION

An object of the present invention is to provide a mirror which has two reflective mirror plates of different magnification factors mounted back-to-back in a frame which contains an internal illumination source that is effective in providing uniform illumination of object fields in front of both mirror plates, the spectral emission characteristics or color temperature of the illumination as well as brightness being adjustable by a user.

Another object of the invention is to provide a dual magnification multi-spectrum table mirror which includes a frame holding back-to-back mirror plates and an internal electrically energizable illumination source that is adjustable to at least three different color temperatures and powered by a power supply within a base to which the frame is pivotably mounted.

Another object of the invention is to provide an adjustable color temperature illuminated dual magnification mirror in which has a frame holding a pair of back-to-back mirror plates and an internal illumination source effective in illuminating object fields in front of both mirrors, the frame being supported by a base including a power supply electrically connected to the illumination source through novel continuously rotatable coaxial connectors which enable continuous rotation of the mirror frame with respect to the base, thus enabling orientation of the mirror plates at any desired pivot angle.

Another object of the invention is to provide an adjustable color temperature illuminated dual magnification mirror in which has a mirror frame assembly including holding a pair of back-to-back mirror plates and an internal illumination source effective in illuminating object fields in front of both mirrors, the mirror frame assembly being rotatably supported between a laterally opposed pair of upstanding arms of a yoke mounted to the upper end of a stanchion which extends upwardly from a base which includes power supply electrically connected to the illumination source through novel continuously rotatable coaxial connectors within the frame assembly which enable continuous rotation of the mirror frame assembly with respect to the base, thus enabling orientation of the mirror plates at any desired pivot angle relative to the base.

Another object of the invention is to provide an adjustable color temperature illuminated dual magnification mirror in which has a mirror frame assembly including holding a pair of back-to-back mirror plates and an internal illumination source effective in illuminating object fields in front of both mirrors, the mirror frame assembly being rotatably supported between a laterally opposed pair of upstanding arms of a yoke at the upper end of a stanchion which extends upwardly from a base which includes power supply electrically connected to the illumination source through novel continuously rotatable coaxial connectors within the frame assembly which enable continuous rotation of the mirror frame assembly with respect to the base, thus enabling orientation of the mirror plates at any desired pivot angle relative to the base, the yoke being mounted to the upper end of the stanchion by a rotatable tubular joint which enables the yoke and mirror assembly to be pivoted about the axis of the rotatable joint from vertical orientations to horizontal orientations.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a dual magnification illuminated multi-spectrum table mirror. The mirror includes a mirror frame assembly which holds therein back-to-back two mirror plates of different magnification factors and an internal illuminator which is effective in illuminating object fields in front of both mirror plates. According to the invention, the mirror includes a base which holds therein an electrical power supply for powering the illuminator, and a support stanchion for the mirror frame assembly which protrudes vertically upwards from the base. The mirror includes a mirror frame support yoke mounted onto the upper end of the stanchion. The yoke has generally the shape of a downwardly concave, generally semi-circularly shaped tubular ring segment. A pair of laterally inwardly facing, diametrically opposed horizontal mirror frame support bushings protrude inwardly from opposite upper ends of the laterally opposed, quadrant-shaped left and right arms of the yoke.

According to the invention, the mirror frame support yoke has a hollow tubular construction, and includes electrical wires for powering the internal illuminator disposed through each support bushing and yoke arm. Lower sections of the illuminator power wires meet at the lower center of the yoke, and are disposed through a hollow tubular passage through the stanchion, Lower ends of the power wire conductors are connected through a selector switch and an intensity control potentiometer to an electrical power supply in the base of the mirror. Upper ends of the illuminator power wires are disposed through the mirror frame support bushings and are rotatably connected to the illuminator within the mirror frame assembly by novel rotatable electrical connectors. The connectors enable continuous rotation of the mirror frame to selected orientation angles relative to the yoke, as is described below.

The mirror frame assembly according to the present invention include a circular hoop-shaped mirror frame which holds coaxially therewithin a pair of back-to-back reflective mirror plates having different magnification factors, e.g., 1× and 5×. Each mirror plate has a relatively large diameter, circular central reflective area and a relatively narrow, outer concentric flat annular band-shaped light transmissive window area. The illuminator within the mirror frame assembly includes a flat, circular ring-shaped printed circuit board (PCB) which is located between the flat inner surface of the 1× mirror plate and the confronting convex inner surface of the 5× magnifying mirror plate, which has a concave outer surface.

The illuminator PCB has the shape of a flat, circular ring-shaped annulus which has protruding radially outwards from the outer peripheral edge thereof a circular ring shaped array of circumferentially spaced apart Light Emitting Diodes (LED's). The LED's of the array include at least two different types of LED's which have different emission spectra, such as white and yellow. In an example embodiment, the LED array consists of 32 yellow and 32 white LED's which are arranged in an alternating pattern, i.e., yellow-white-yellow, etc. Preferably, the LED's are arranged to protrude radially outwards of the outer circumferential edge wall of the PCB.

The outer annular ring-shaped light transmissive regions of the two back-to-back reflective mirror plates are axially aligned, and positioned on opposite sides of the illuminator LED's located between inner facing sides of the mirror plates. In a preferred embodiment, the inner face of each mirror plate has thereon a surface which specularly or diffusely reflects light emitted from the LED's, thus directing light through the annular ring-shaped windows of opposed mirror plates.

According to the invention, a first, common set of electrically interconnected conductive traces on the annular ring-shaped PCB are connected to a first-polarity terminal lead of each of the LED's on the PCB, such as the negative-voltage cathode terminals. The first, common set of traces is in turn electrically connected to the negative output terminal of a d.c. power source through a first, single-conductor continuously rotatable electrical connector.

A single-conductor rotatable connector according to the present invention includes a conductor such as a wire which protrudes through the bore of one of the two mirror frame assembly support bushings which rotatably support the mirror frame assembly and into the interior of the mirror frame assembly. The inwardly protruding end of the single conductor is rotatably received in electrically conductive contact within the bore of a radially disposed electrically conductive copper connector tube that is mounted on the surface of the PCB. The single-conductor connector tube is disposed radially between inner and outer circumferential edges of the PCB, in alignment with a first support bushing, and is electrically conductively connected to the first, common cathode set of PCB traces, as by a soldered joint to one of the traces.

The mirror according to the present invention includes a second, two-conductor rotatable electrical connector which is located on a side of the PCB diametrically opposed to the first, single-conductor rotatable connector. The two-conductor connector includes an inner radially disposed electrically conductive copper connector tube which is similar in construction and function to the single-conductor connector tube. This inner connector tube is mounted on the same surface, e.g., the front or obverse surface of the PCB as the single-conductor connector tube, and is disposed radially between inner and outer edges of the PCB in radial alignment with the single-conductor connector tube located on the opposite side of the PCB. The inner connector tube of the two-conductor connector receives rotatably in electrically conductive contact within its bore the center conductor of a coaxial cable which is received through the bore of a second mirror frame assembly support bushing located on the side of the mirror frame opposite the first support bushing.

The two-conductor rotatable electrical connector includes a second, outer radially disposed connector tube spaced radially outwards from and in axial alignment with the inner connector tube. The outer connector tube has a larger diameter bore which receives rotatably in electrically conductive contact the outer conductor of the coaxial cable disposed through the bushing.

The insulation overlying the outer conductor of the end part of coaxial cable which is received in the dual-conductor connector within the mirror frame assembly is stripped back a short distance from the end to expose the outer conductor of the cable before it is inserted into the outer connector tube. Preferably, a copper ferrule having a smoother outer wall surface than the outer conductor of the coaxial cable, which is typically a braided wire shield, is crimped onto the outer conductor of the coaxial cable before the cable is inserted into the outer connector tube, to reduce friction when the mirror frame connector and tube are rotated relative to the fixed yoke bushing and cable.

According to the invention, the inner connector tube of the two-conductor connector is electrically conductively connected to a second set of traces on the PCB. The second set of traces are connected through individual ballast resistors mounted on the PCB to the anode terminal leads of all the LED's of a first type, e.g., white-light emitting LED's, mounted on the PCB.

Also, the radially outwardly located, larger bore outer connector tube which receives the outer conductor of the coaxial cable is electrically conductively connected to a third set of traces on the PCB. The third set of traces are connected through individual ballast resistors mounted on the PCB to the anode terminal leads of all the LED's of a second type, e.g., yellow-light emitting LED's, mounted on the PCB.

According to the invention, a single conductor insulated wire disposed through the bore of a first mirror support bushing fastened to a first tubular yoke arm is disposed through the bore of the first yoke arm to a first terminal, e.g., a negative voltage terminal of a d.c. power source located within the base of the mirror. Also, an insulated coaxial cable is disposed through the second mirror support bushing and bore of the second yoke arm into the base of the mirror. Here the inner and outer conductors of the coaxial cable are connected to the switched terminals of a selector switch which has an input terminal connected to a second terminal of the d.c. power source, e.g., the positive voltage terminal.

With the selector switch set to energize only white-light LED's, the color temperature of light emitted from the LED's and transmitted through the annular mirror windows to thus illuminate an object such as a person's face positioned adjacent to the outer reflective surface of either reflective mirror plate is approximately 6400 K, simulating an office illumination environment.

With the selector switch set to energize only the yellow LED's, the color temperature of light emitted by the mirror illuminator is approximately 4000 K, simulating an evening illumination environment.

With both the 32 white LED's and 32 yellow LED's selected by the selector switch, the illumination produced by the mirror illuminator approximates that of daylight.

According to the invention, the mirror includes a device such as an adjustable resistor or potentiometer for controlling the intensity of light emitted by the illuminator in all of the three spectral modes. Optionally, the mirror may include two potentiometers to thus enable separate control of intensity of light emitted by the two different types of LED's. With this arrangement, the spectral characteristics of light emitted by the mirror illuminator may be varied continuously over a range of color temperatures. According to another option, the LED's are energized by a pulse-width-modulated (PWM) current source operated at a frequency above that which is discernible as a flicker by a human observer.

The novel combination of single-conductor and dual-conductor rotatable electrical connectors of the multi-spectrum table mirror according to the present invention enables the mirror frame assembly to be rotated continuously within its support yoke to any desired inclination angle of either of the two reflective mirror plates, without any twisting or binding of the electrical wires used to power the LED illuminator within the mirrorframe assembly. Maintenance of the mirror frame at a selected inclination angle relative to the support yoke is accomplished by separate friction washers positioned between the upper end of each yoke arm and the mirror frame.

Optionally and preferably, the mirror frame support yoke is supported at its lower end by a rotatable joint. The rotatable joint includes a transversely disposed horizontal yoke support tube mounted to the upper end of a support stanchion extending upwards form the mirror base. The centrally located lower end of the tubular mirror frame support yoke is rotatably supported within a bore disposed through the horizontal yoke support tube mounted to the upper end of the support stanchion extending upwards form the mirror base. This construction enables the yoke and mirror frame assembly to be pivoted downwardly from a vertical or near-vertical orientation to a substantially horizontal orientation which is useful for storing and shipping the mirror. Maintenance of the yoke at a selected inclination angle relative to the stanchion is accomplished by a friction bushing positioned between the inner wall surface of the bore through the yoke support tube and the outer wall surface of the yoke.

Pivotability of the mirror frame support yoke with respect to the stanchion and mirror base enables the height of the mirror frame to be adjusted over a wide range for the convenience of a user of the mirror. This pivotability also enables the yoke and mirror frame to be pivoted downwardly into close proximity to the base of the mirror, thus reducing the envelope size of the mirror to a small value which facilitates packaging, shipping, and storing the mirror.

The annular ring-shaped illumination source is constructed in a manner that enables the mirrorframe to have a substantially thinner, more aesthetically satisfying appearance than prior-art illuminated mirrors which employ incandescent or fluorescent illumination sources. The LED's protrude radially outwards of the outer circumferential edge wall of the printed circuit board.

In an example embodiment, each LED had a cylindrically-shaped, body and a pair of conductive leads which protruded rearward from the body. Rear ends of the leads were bent at ninety degree angles and inserted into and soldered to conductive eyelets electrically continuous with a pair of conductive foil strips arranged concentrically on the pivoted circuit board.

The novel design and construction of a dual magnification multi-spectrum illuminated mirror according to the present invention provides equally bright, uniform illumination of objects located in front of both mirror plates, with light that is adjustable in color temperature as well as brightness. Moreover, the novel design and construction of the mirror according to the present invention advantageously enables the mirror frame to be continuously rotated to thus position the 1× or 5× magnifying mirror plates at any desired angle with respect to the mirror frame support yoke, without the possibility of twisting or breaking electrical illumination wires which power the illumination source within the mirror frame.

DESCRIPTION OF THE PREFERRED EMBODIMENTS

Figure 1:
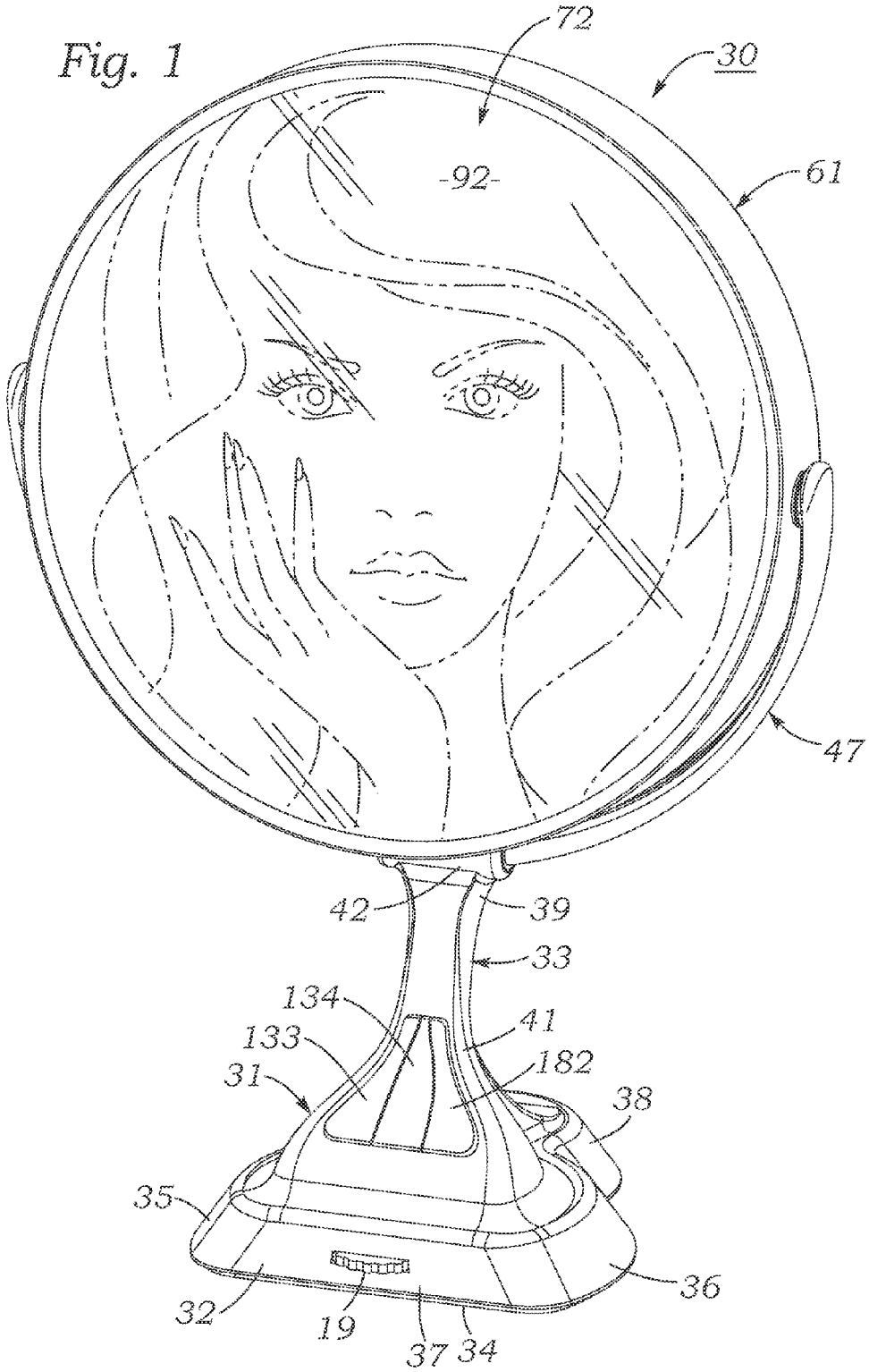
FIG. 1 is a front perspective view of a Dual Magnification Multi-Spectrum Illuminated Table Mirror according to the present invention.

FIGS. 1-24 illustrate a dual magnification illuminated multi-spectrum table mirror according to the present invention.

Referring first to FIGS. 1-6, it may be seen that a dual magnification illuminated multi-spectrum table mirror 30 according to the present invention includes a hollow, generally conically-shaped lower section 31 which includes a base 32 and integral support stanchion 33 which extends upwardly from the base. As shown in the figures, base 32 has a flat lower wall surface 34 for placement on a supporting surface such as a table top.

Figure 2:
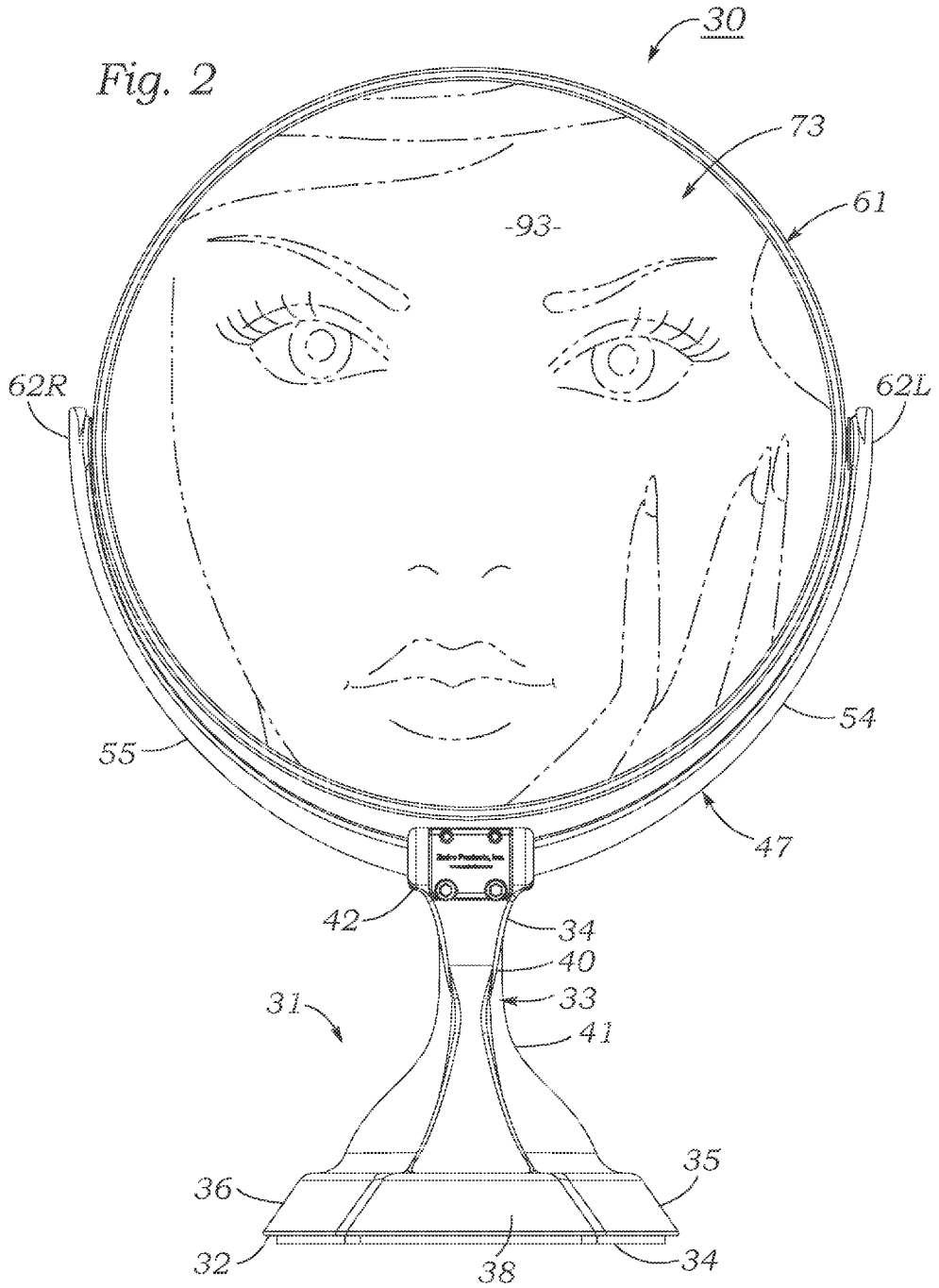
FIG. 2 is a rear elevation view of the mirror of FIG. 1.

As may be seen best by referring to FIGS. 1 and 2, lower section 31 of mirror 30 has a laterally symmetric shape which includes mirror-symmetric, convex arcuately curved left and right sides 35, 36 which extend upwardly from base 32. Base 32 also has a convex, arcuately curved front side 37 and a shorter, straight rear side 38.

Figure 3:
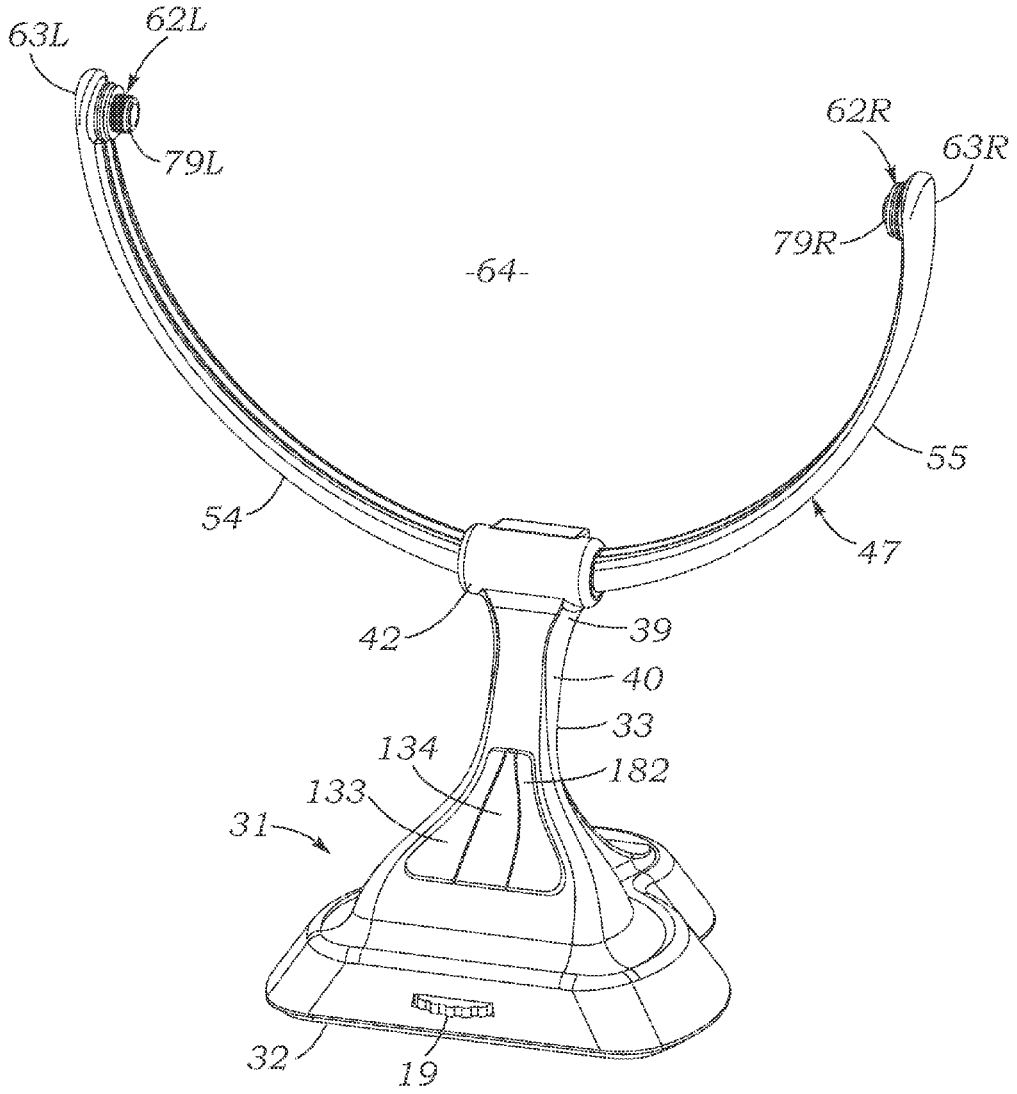
FIG. 3 is a fragmentary front perspective view of the mirror of FIG. 1, showing a mirror frame assembly thereof removed.
Figure 4A:
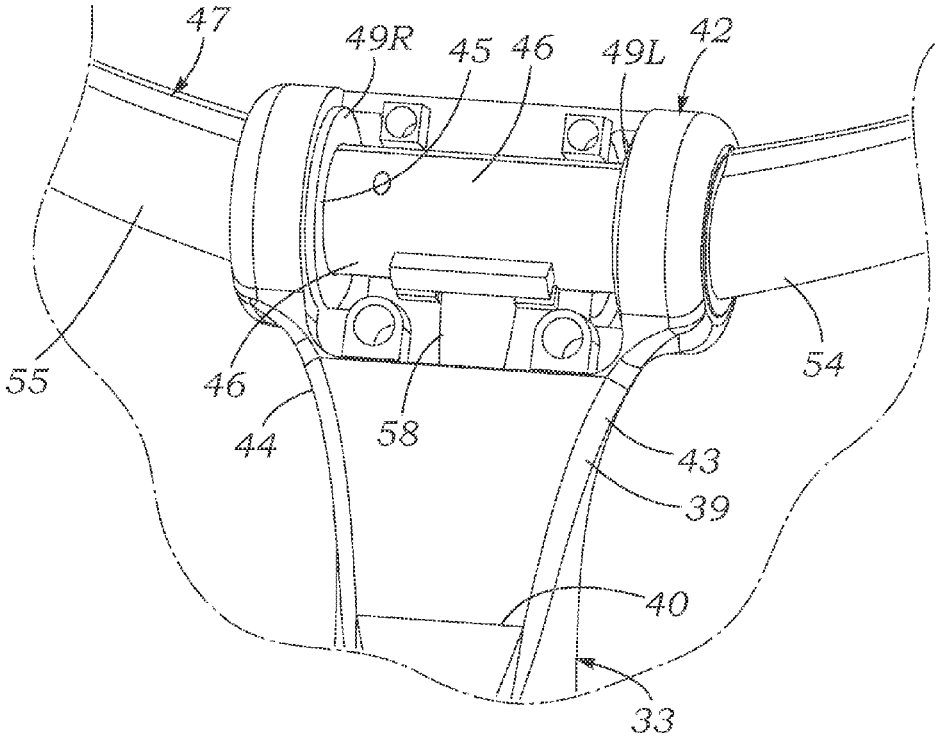
FIG. 4A is a fragmentary exploded rear view of the mirror of FIG. 3.

As shown in FIGS. 1-3, stanchion 33 of mirror 30 has a radially outwardly tapered upper neck section 39 which extends upwardly from an upper truncating collar plane 40 of a conically-shaped central part 41 of the lower section 31. As may be seen best by referring to FIG. 4A, upper neck section 39 of stanchion 33 has at an upper end thereof a hollow cylindrically shaped yoke support tube 42. As shown in FIG. 4A, yoke support tube 42 is disposed horizontally and extends equal distances outwardly of left and right sides 43,44 of stanchion 33.

Referring to FIGS. 1-4A, it may be envisioned that yoke support tube 42 has through its length a coaxial, circular cross-section bore 45. Bore 45 receives rotatably therein the center lower section 46 of a mirror frame support yoke 47. As shown in FIGS. 4A and 4B, yoke 47 has generally the form of a uniform diameter, circular cross-section, hollow tube which is curved into a semi-circular arc and has disposed through its length a uniform diameter, circular cross-section bore 48 which includes a central segment 48C that is disposed through lower center section 46.

As may be understood by referring to FIGS. 4A, 4B, 5, 7, and 21A, yoke 47 is pivotable within bore 45 of yoke support tube 42 over a range of about 135 degrees, and is maintained at a desired pivot angle by means of a pair of left and right longitudinally spaced apart friction bushings 49L, 49R which are positioned coaxially between the outer surface 50 of the yoke and the inner surface 51 of bore 45 through yoke support tube 42.

As shown in FIGS. 1-4B, yoke 47 has extending upwards from left and right sides 52, 53 of center lower section 46 of the yoke left and right arcuately curved tubular yoke arms 54, 55, which have generally the shape of lower left and right quadrants of a semicircular tubular half ring. As shown in FIGS. 21A, 21B, 22 and 23, left and right yoke arms 54, 55 of yoke 47 have disposed coaxially through their lengths bore segments 48L, 48R which extend from and are continuous with left and right ends of central bore segment 48C through center lower section 46 of the yoke.

Figure 4B:
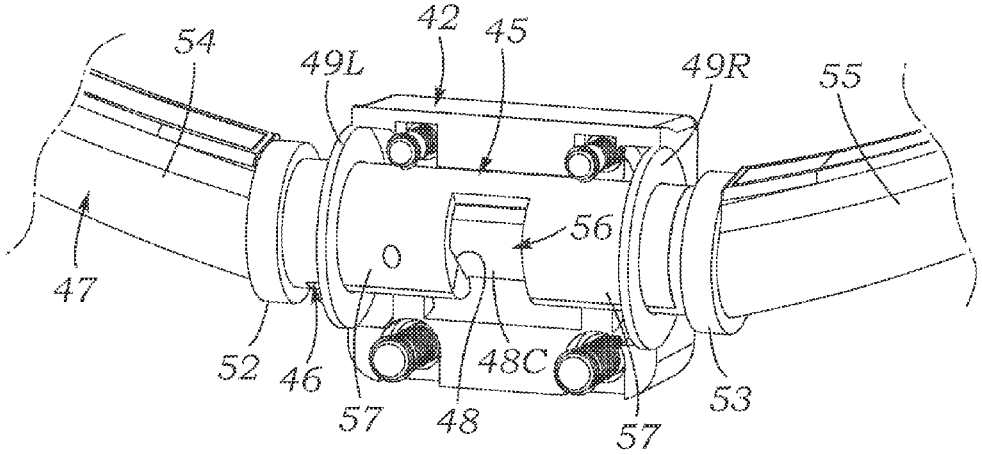
FIG. 4B is a fragmentary exploded front view of the mirror of FIG. 3
Figure 6:
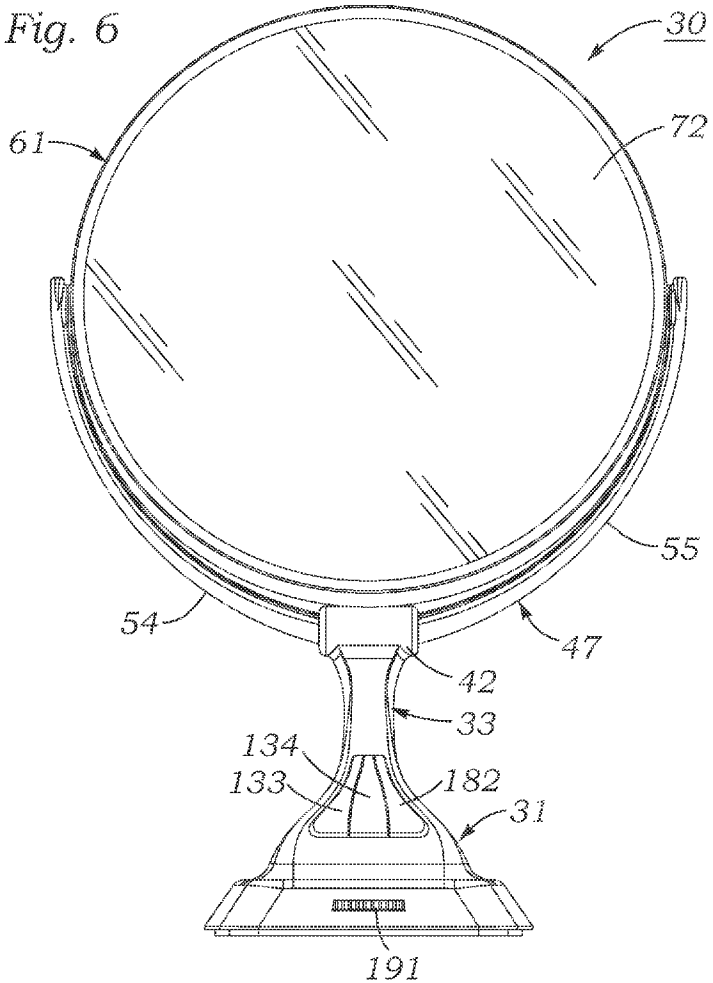
FIG. 6 is a front elevation view of the mirror of FIG. 5.
Figure 5:
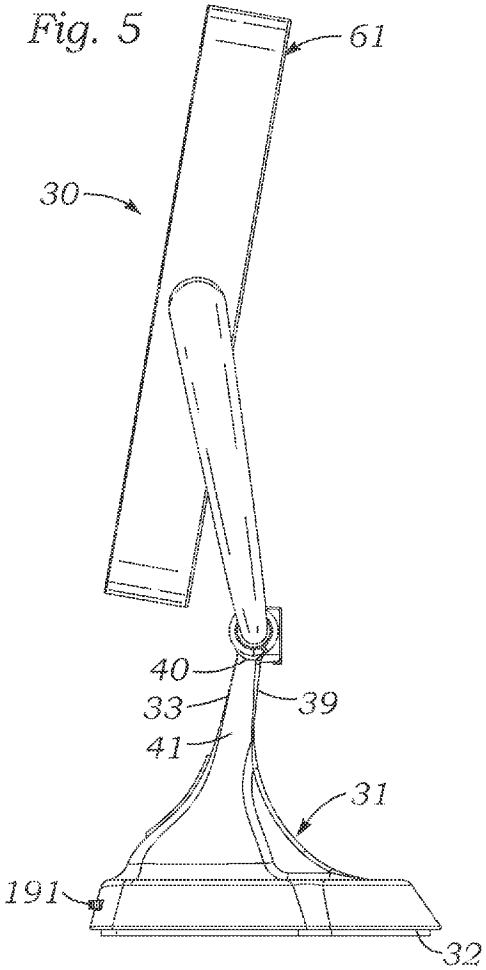
FIG. 5 is a right side elevation view of the mirror of FIG. 1, showing the mirror in a first alternate configuration in which a mirror frame thereof is tilted upward about a first, mirror-frame pivot axis.
Figure 7:
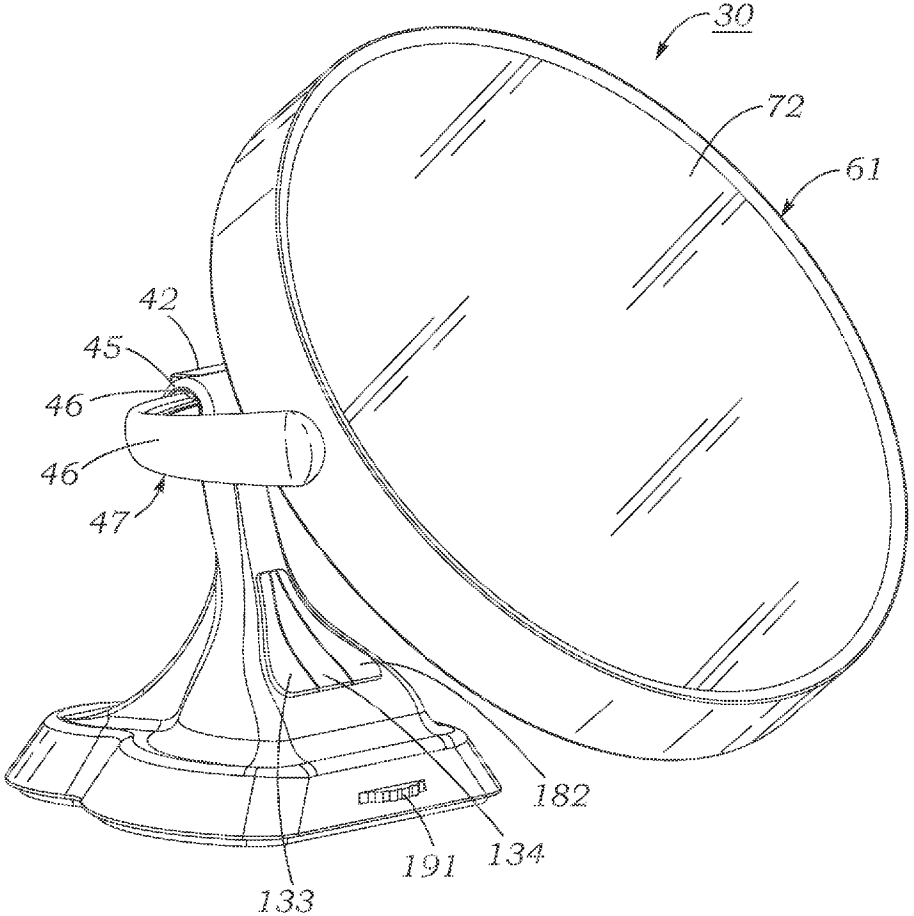
FIG. 7 is a perspective view of the mirror of FIGS. 1 and 2, showing the mirror in a second alternate configuration in which a mirror frame support yoke thereof is pivoted downward and forward about a second, mirror frame support yoke pivot axis from the vertical orientation shown in FIGS. 1 and 2 to a horizontal orientation.

As shown in FIG. 4B, for a purpose which will be explained in more detail below, lower center section 46 of yoke 47 has a perforation 56 which penetrates cylindrical wall 57 of the yoke and thus communicates with central bore section 48C through the yoke. Perforation 56 communicates with an aligned perforation 58 in yoke support tube 42, which in turn communicates with the upper end of a passageway 59 through stanchion 33. The lower end of passageway 59 communicates with a cavity 60 in lower section 31 of the mirror.

As shown in FIGS. 1-3, mirror 30 includes a mirror frame assembly 61 which is supported by a pair of laterally opposed, left and right rotatable joints 62L, 62R, respectively located at upper ends 63L, 63R of left and right yoke arms 54, 55. These joints enable continuous rotatability of mirror frame assembly 61 within the space 64 between yoke arms 54,55. FIGS. 8-23 illustrate details of the construction of mirror frame assembly 61 and left and right rotatable joints 62L, 62R.

Referring now to FIGS. 8-23, it may be seen that mirror frame assembly 61 includes a circular hoop-shaped frame ring 65. As shown in FIG. 9, frame ring 65 has generally the form of a short, circular cross-section uniform thickness right-cylindrically shaped shell which has parallel inner and outer circumferential surfaces 66, 67. Front and rear circular edges 68, 69 of frame ring 65 are bent inwardly during manufacture of mirror frame assembly 61 to form front and rear annular bezel flanges 70, 71 for retaining front and rear reflective mirror plates 72, 73.

Figure 22:
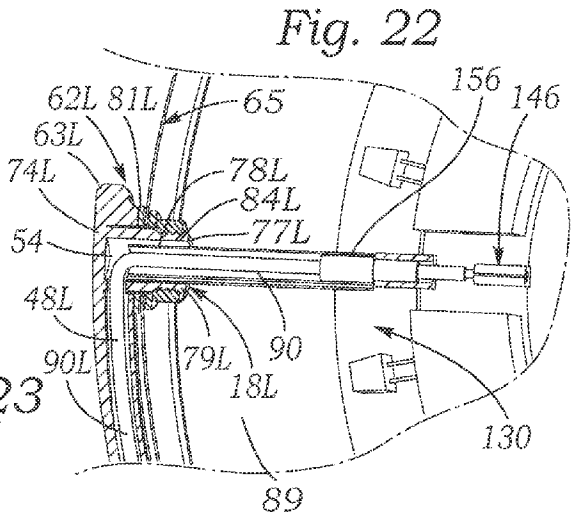
FIG. 22 is a fragmentary view of the mirror of FIG. 21B, on an enlarged scale.
Figure 23:
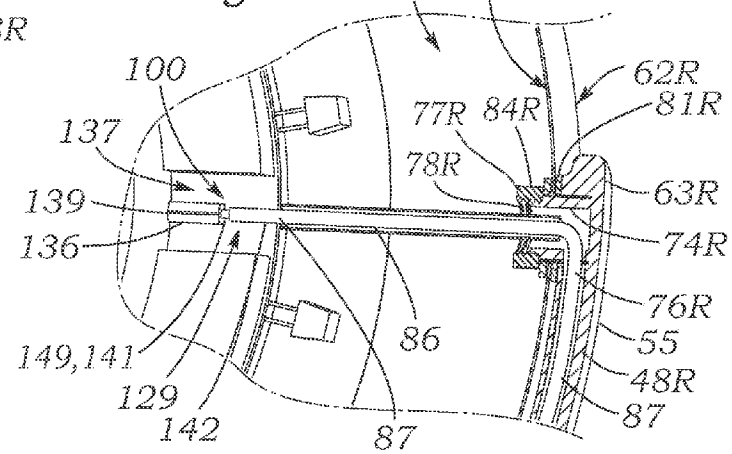
FIG. 23 is another fragmentary view of the mirror of FIG. 21B, showing electrical wire routing thereof.
Figure 21B:
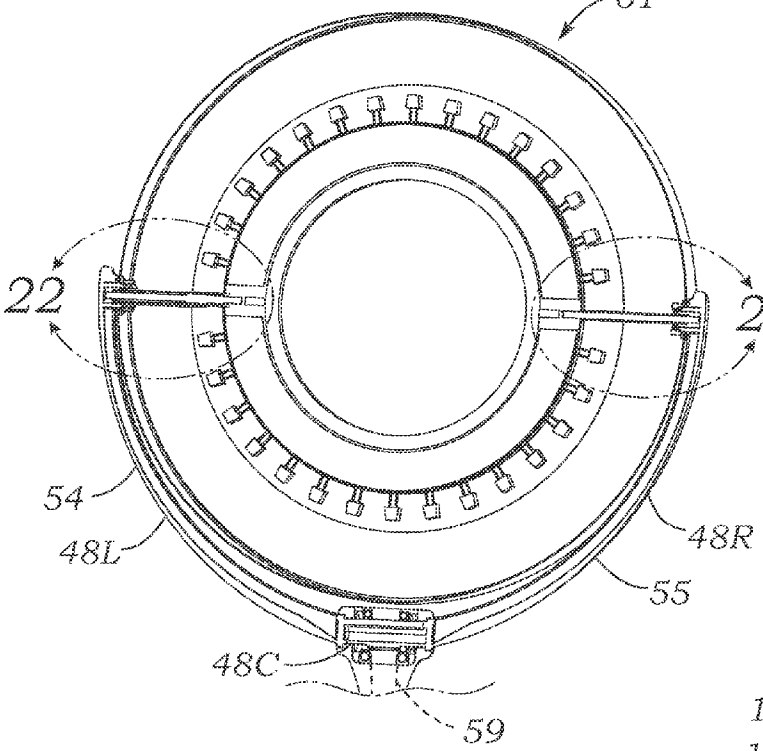
FIG. 21B is a fragmentary partly broken away view of the mirror of FIG. 1.

As shown in FIGS. 22 and 23, each joint 62L, 62R includes respectively, right-angle transition sections 74L, 74R in the upper ends 63L, 63R of yoke arms 54, 55. Each transition section 74L, 74R has through an inner vertical face 77L, 77R thereof a horizontally disposed bore 78L, 78R which communicates with a vertical bore 76L, 76R that extends through the transition section.

Each horizontal bore 78L, 78R, receives therein an externally threaded tubular bushing 79L, 79R. As may be understood by referring to FIGS. 22 and 23, each bushing 79L, 79R, is disposed through the central circular hole 80L, 80R of a friction washer 81L, 81R. The inner externally threaded end 82L, 82R of each bushing 79L, 79R is in turn received through a bore 83L, 83R through frame ring 65. The inner externally threaded end 82L, 82R of each bushing 79L, 79R is fixed to frame ring 65 by a ring nut 84L, 84R and lock washer 85L, 85 threadingly tightened onto the inner externally threaded end of the bushing protruding inwardly of inner surface 68 of the frame ring.

As shown in FIG. 23 and described in detail below, the interconnected vertical and horizontal bore pairs 76L-78L, 76R-76L of each transition section 74L, 74R receive therethrough a flexible insulating left-hand and right-hand sleeve 86L, 86R, respectively. One sleeve, e.g., right-hand sleeve 86R receives therethrough an upper part of a single conductor insulated electrical wire 87. As shown in FIG. 23, an upper end part of sleeve 86R and enclosed wire 87 protrude inwardly through a bore 88R through bushing 79R into the interior space 89 of mirror frame assembly 61. The other sleeve, e.g., left-hand sleeve 86L, receives therethrough an upper part of a two-conductor coaxial electrical cable 90. An upper end part of sleeve 86L and enclosed coaxial cable 90 protrude inwardly through a bore 88L through bushing 79L into the interior space 89 of mirror frame assembly 61.

The lower part of single-conductor insulated electrical wire 87 is disposed through left-hand sleeve 86L and bore segment 48L of left-hand yoke arm 54, and thence through perforations 56 and 58 and through passageway 59 through stanchion 33 to connect to a d.c. power supply 91 located in cavity 60 in lower section 31 of mirror 30.

Similarly, the lower part of two-conductor coaxial cable 90 is disposed through right-hand sleeve 86R and bore 48R of right-hand yoke arm 55, and thence through perforations 56 and 58 and through passageway 59 through stanchion 33 to connect to power supply 91 located in cavity 60 in lower section 31 of mirror 30.

The structure of mirror assembly 61, and its functional interaction with other components of mirror 30, may be best understood by referring to FIGS. 8-11.

As may be seen best by referring to FIGS. 1, 2, 8 and 9, front and rear mirror plates 72, 73 are circularly-shaped and have central outwardly facing circularly reflective surfaces 92, 93, respectively, which occupy a substantially large portion of the area of the mirror plates. A first one of the mirror plates, such as mirror plate 72, shown in a front-facing orientation in the figures, has a flat outer reflective surface 92 which produces "1×", non-magnified reflected images of objects such as the face of a person positioned close to the reflective surface. The second mirror plate 73 has a reflecting surface 93 which is concave, thus producing magnified e.g., "5×" images of objects positioned closely to the reflective surface.

Figure 8:
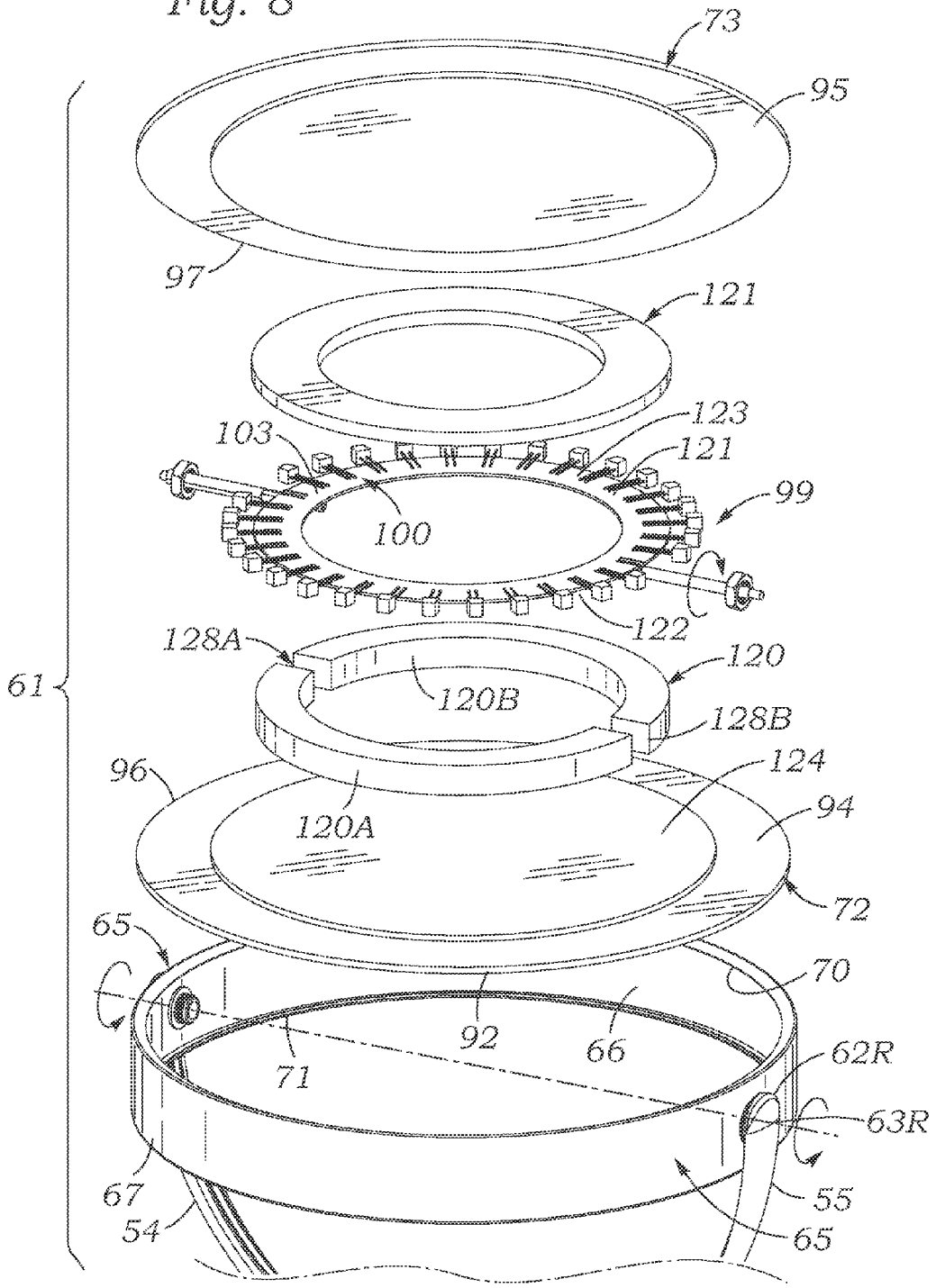
FIG. 8 is an exploded fragmentary upper perspective view of the mirror of FIG. 1, showing details of a mirror frame assembly thereof.
Figure 9:
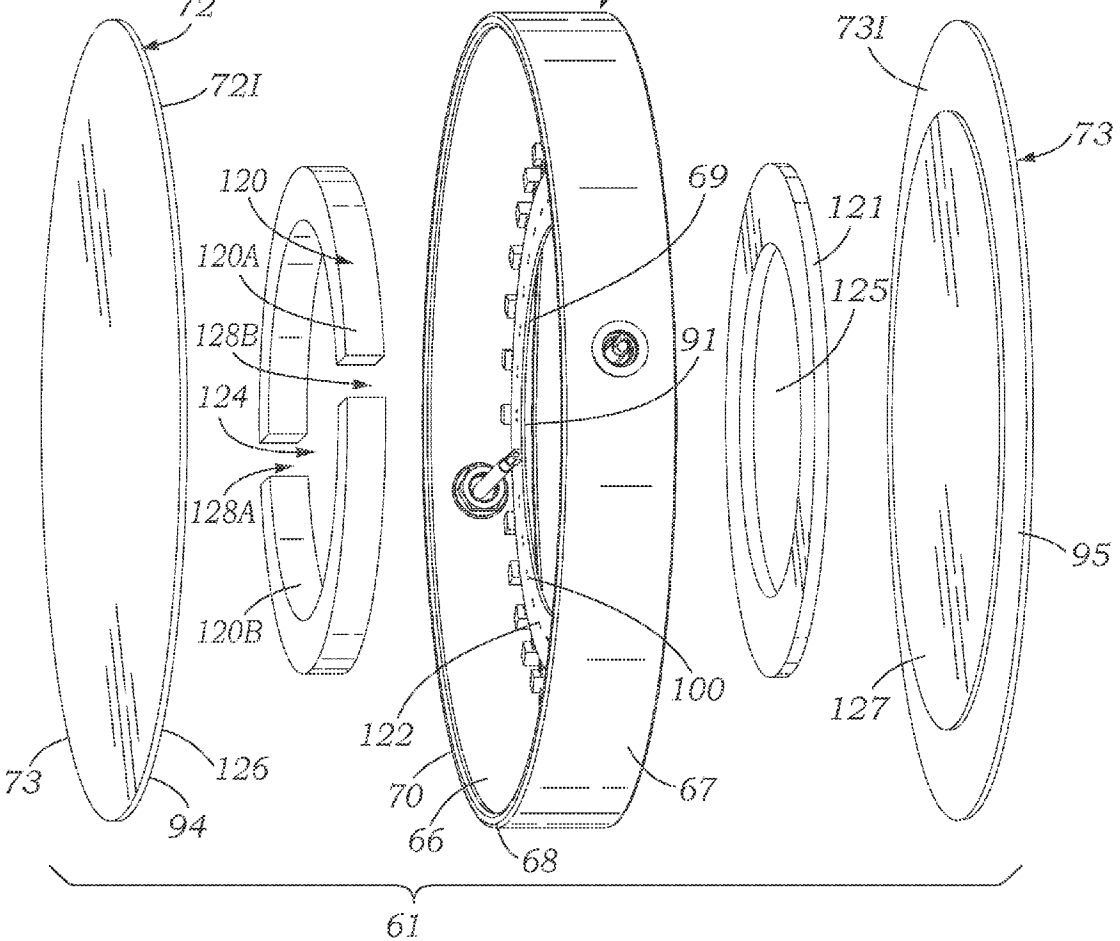
FIG. 9 is an exploded fragmentary side perspective view of the mirror frame assembly of FIG. 8.
Figure 11:
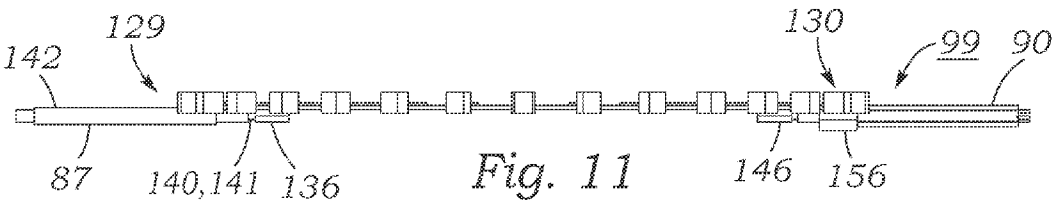
FIG. 11 is an edge elevation view of the LED ring of FIG. 10.

As is shown in FIGS. 8 and 9, front and rear mirror plates 72, 73 have narrow outer peripheral annular ring-shaped window bands 94, 95 which encircle the central reflective surfaces 92, 93, respectively. Window bands 94, 95 are light transmissive, and preferably made of a transparent material which has frosted inner facing surfaces 96, 97 so that light passing through the window bands is diffused. Also, as shown in FIG. 15A, inner surfaces 96, 97 of diffusely transmitting window bands 94, 95 have a beveled shape, so that the outer circumferential edges of the bands are thinner than the inner circumferential edges of the bands.

Figure 13:
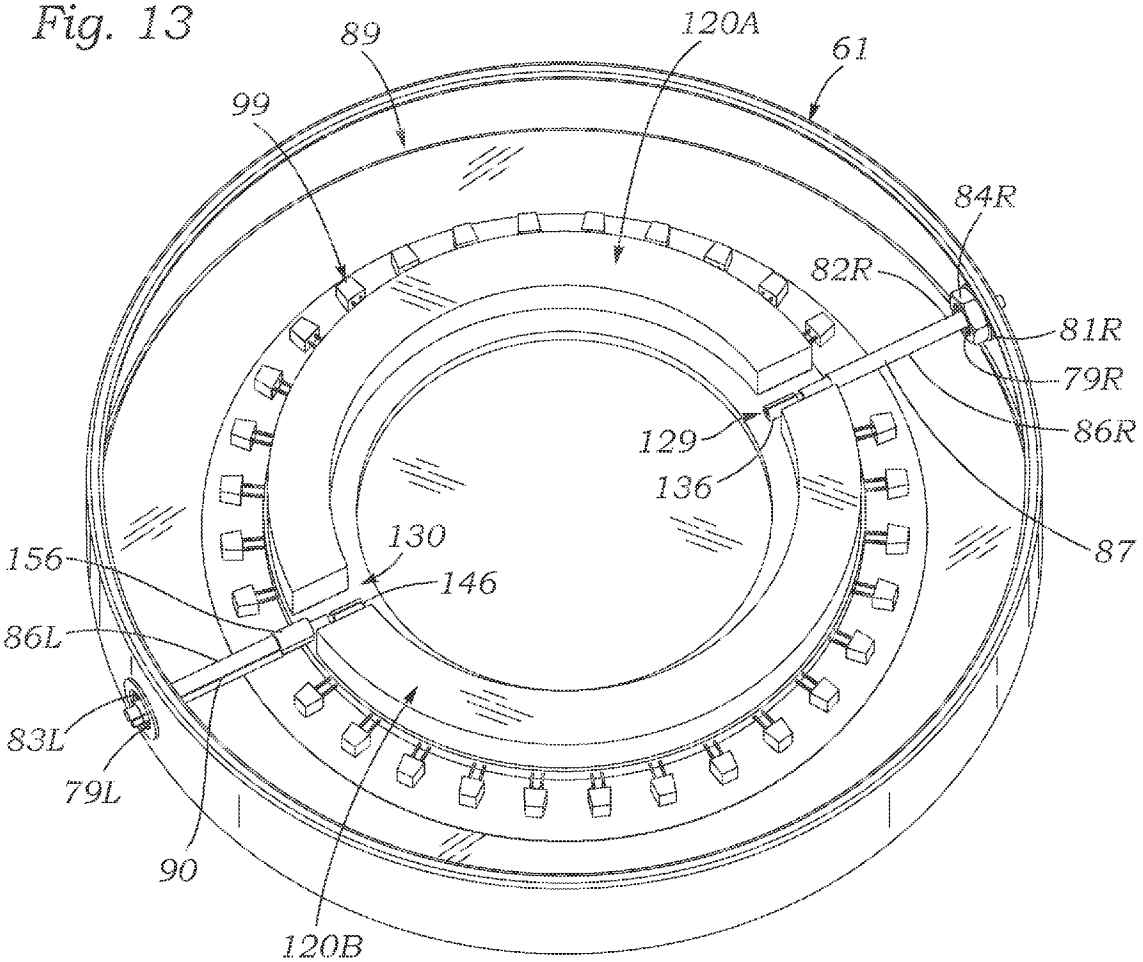
FIG. 13 is a fragmentary perspective view of the mirror frame assembly of FIG. 8.
Figure 15:
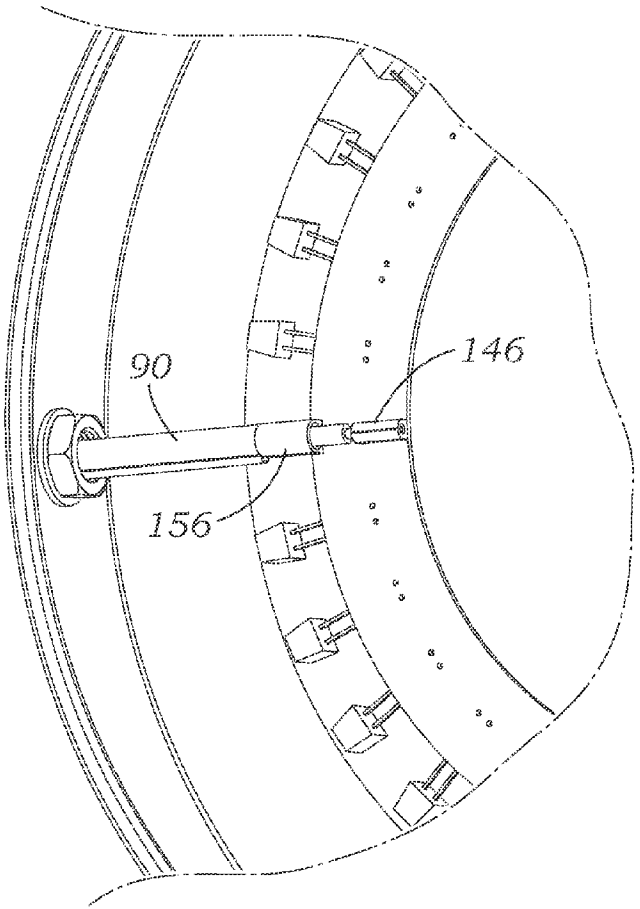
FIG. 15 is a fragmentary view of the mirror frame assembly of FIG. 14, showing on an enlarged scale a dual conductor coaxial rotatable electrical connector thereof.
Figure 14:
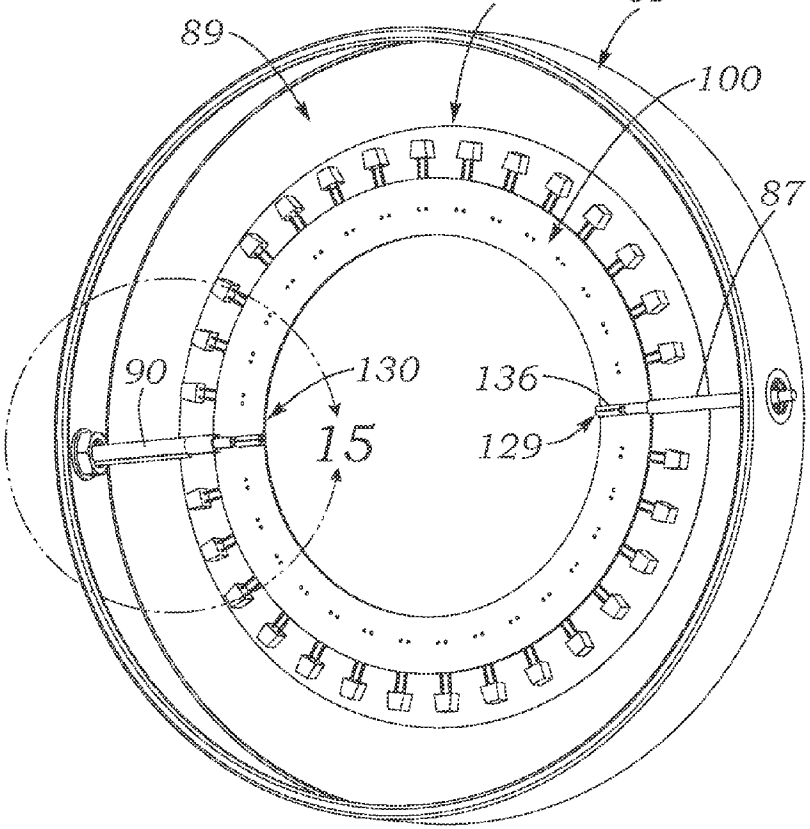
FIG. 14 is a fragmentary perspective view of the mirror frame assembly of FIG. 8, showing single conductor and dual conductor rotatable electrical connectors thereof.
Figure 18:
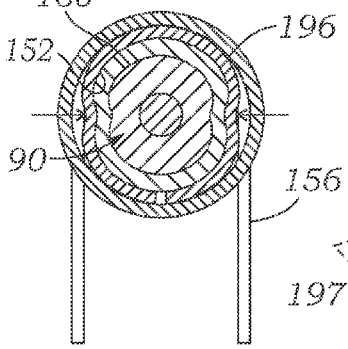
FIG. 18 is a transverse sectional view of the connector of FIG. 17.
Figure 16:
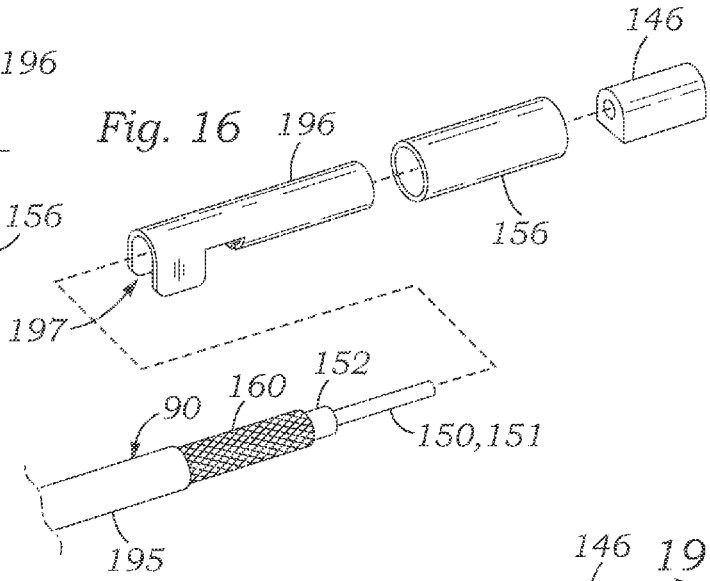
FIG. 16 is an exploded fragmentary view of the connector of FIG. 15.
Figure 17:
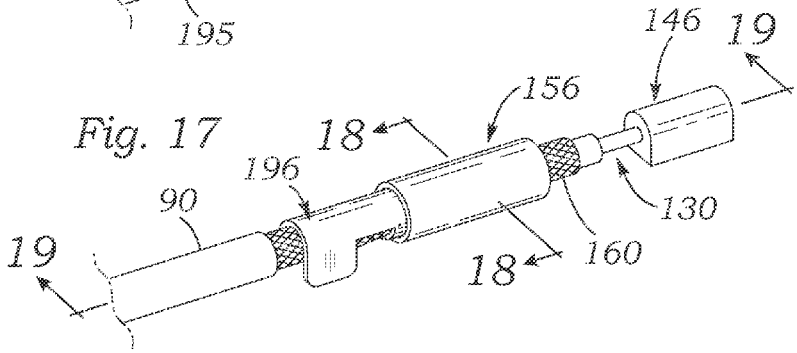
FIG. 17 is an assembled view of the connector of FIG. 16.
Figure 19:
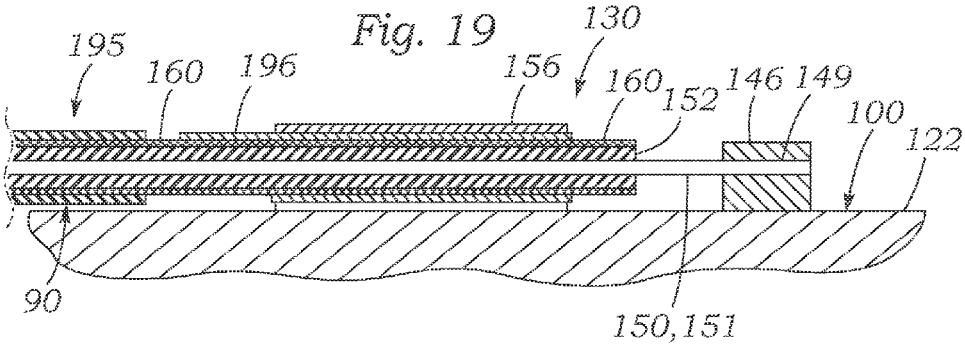
FIG. 19 is a longitudinal sectional view of the connector of FIG. 17.
Figure 21A:
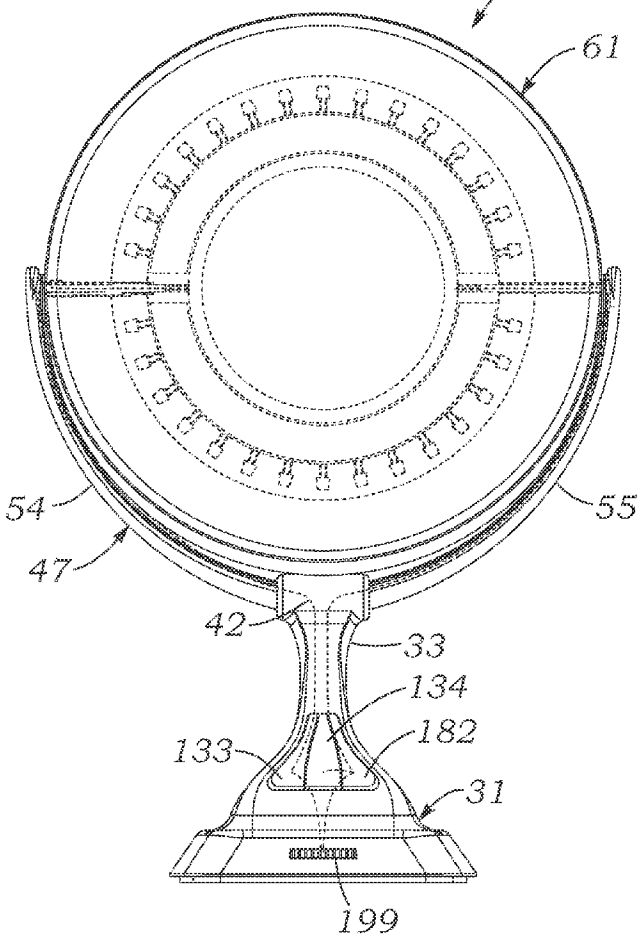
FIG. 21A is a skeletal front view of the mirror of FIG. 1.
Figure 20:
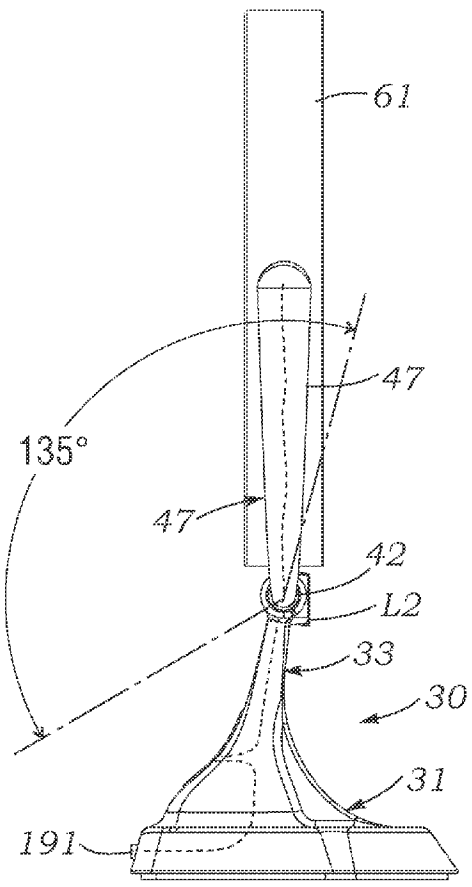
FIG. 20 is a side elevation view of the mirror of FIG. 1.

Referring to FIGS. 13-14, it may be seen mirror frame assembly 61 has an interior space 89 which has therewithin a circular ring-shaped, multi-spectral illuminator 99. As shown in FIGS. 8-14, illuminator 99 includes a thin, flat, annular ring-shaped printed circuit board 100. Printed circuit board 100 has mounted thereto a circular ring-shaped array of light emitting diodes (LED's) which protrude radially outwardly of the outer circular circumferential edge wall 102 of the printed circuit board. The array includes a group of white-light emitting LED's 101 which are arranged in a circle and are spaced circumferentially apart from each other at a distance somewhat greater than the width of each LED.

As may be best understood by referring to FIGS. 10-12 and 24, illuminator 99 also includes a group of yellow-light emitting LED's 103 which are arranged in a circle and located in the spaces between pairs of white-light emitting diodes 101. In an example embodiment of mirror 30, each LED 101, 103 has a cylindrically-shaped body 104, 105. Each white LED 101 has a pair of conductor leads including a cathode lead 106 and an anode lead 107, and each yellow LED has a pair of cathode-anode leads 108-109 which protrudes outwardly from the body. Outer ends of the leads 106, 107 of each LED 101 and leads 108, 109 of each LED 103 are bent at ninety degree angles relative to the longitudinal axis of the LED body, and inserted into and soldered to a separate pair of electrically conductive, cathode and anode eyelets 110-111, 112-113, respectively. Each of the cathode eyelets 110 of white LED's 101 is electrically connected to a first circular ring-shaped conductive cathode foil trace 114, and each of the cathode eyelets 112 of yellow LED's 103 is connected to a second circular ring-shaped conductive cathode foil trace 115 arranged concentrically on printed circuit board 100. Each of the white LED anode eyelets 111, and each of yellow LED anode eyelets 113 is connected to a first, load-side terminal of a separate surface mount ballast resistors 116, 117, respectively. A second, supply side terminal of each white LED ballast resistor 116 is connected to a first circular ring-shaped conductive anode foil trace 118, and a second, supply side terminal of each yellow LED ballast resistor 117 is connected to a second circular ring-shaped conductive anode foil trace 119 arranged concentrically on printed circuit board 100.

In an example embodiment, multi-spectral illuminator 99 included a circular ring of 64 LED's consisting of 32 white-light emitting diodes 101 spaced apart at equal circumferential intervals of about 8 degrees and interspersed with 32 yellow-light emitting LED's 103.

Referring to FIGS. 8 and 9, it may be seen that inner facing central circular portions of mirror plates 72, 73 preferably have reflective surfaces 721, 731. The function of the inner facing reflective surfaces is to reflect light emitted by LED's 101,103 obliquely towards opposite window bands 94, 95, thus increasing the illumination intensity of objects in front of mirror plates 72, 73. To increase the transfer efficiency of light emitted by LED's 101, 103 through annular mirror window bands 94, 95, outer annular edge portions 920, 930 of reflective surfaces 721, 731 are preferably angled in the same sense as the beveled inner annular edges of mirror plates 72, 73. In an example embodiment of mirror 30, reflective surfaces 721, 731 consisted of thin circular sheets of specularly reflective aluminized Mylar adhered to inner facing surfaces of front and rear mirror plates 72, 73.

Referring to FIGS. 8, 9, 13 and 14, it may be seen that mirror assembly 61 includes a front and rear circular disk-shaped insulating spacers 120, 121 which are adhered to front and rear surfaces 122, 123, respectively of printed circuit board 100. Spacers 120, 121, which may for example be made of a foam board, i.e., a thin sheet of pasteboard to which is laminated a thicker lamination made of a high-density polymer foam, preferably have central apertures 124, 125 to provide clearance for inner surfaces of mirror plates 72, 72.

As may be seen best by referring to FIGS. 8, 9, 13 and 14, front spacer ring 120, which is located between the back surface 126 of front mirror plate 72 and front surface 122 of PCB 100, is sufficiently thick to space the mirror plate away from the PCB. As may also be understood by referring to those figures, rear spacer 121 can be thinner than front spacer 120 because of the convex shape of inner surface 127 of outwardly concave rear mirror plate 73, which curves arcuately outwards from rear surface 123 of PCB 100.

Preferably, front and rear spacer rings 120, 121 are made of a white, diffusely reflective polymer foam which has an adhesive backing which facilitates adhering the spacer rings to the inner surfaces of mirror plates 72, 73. Front and rear spacer rings 120, 121 are effective in diffusely reflecting light emitted by LED's 101, 103, and in cushioning components of mirror frame assembly 61 from impact shocks to mirror 30.

As shown in FIGS. 8, 9 and 13, front spacer ring 120 is preferably constructed as a pair of semi-annular, circular arc-shaped, rectangular cross-section segments 120A, 120B. Confronting pairs of radially disposed end faces of segments 120A, 120B are separated by a pair of diametrically opposed, radially disposed and aligned slots '128A, 128B. The slots 128A, 128B are provided to receive novel continuously rotatable electrical connectors, which are described below.

FIGS. 8-23 illustrate novel continuously rotatable electrical connectors of mirror 30 which enable electrical power to be conveyed from power supply 91 in the base section 31 of the mirror to selectable combinations of two different color LED's of illuminator 99 within mirror frame assembly 61, while allowing continuous rotatability of the mirrorframe assembly within the space 64 between left and right arms 54, 55 of mirror frame support yoke 47.

As shown in FIGS. 10, 11, 14 and 23, mirror 30 includes a single conductor rotatable electrical connector 129 located near a right-side of outer circumferential edge 102 of PCB 100, and a two-conductor rotatable electrical connector 130 located at a diametrically opposed location on the left side of the PCB. The single-conductor connector 129 provides a common or return electrical path between an interconnection node which joins the cathode leads 106 of all white LED's 101 and the cathode leads of all yellow LED's 103, and the negative terminal 131 of power supply 91 located in cavity 60 in base section 31 of mirror 30. The two-conductor rotatable electrical connector 130 provides separate electrical paths between anode leads 107 of white LED's 101 and anode leads 109 of yellow LED's 103 through separate switches 133, 134 to a positive terminal 135 of power supply 91.

Referring now to FIGS. 10, 13, 14 and 23, it may be seen that single-conductor rotatable connector 129 includes a short copper connector tube 136 which is mounted to a flat planar surface, e.g., the front surface 122, of PCB 100.

Figure 10:
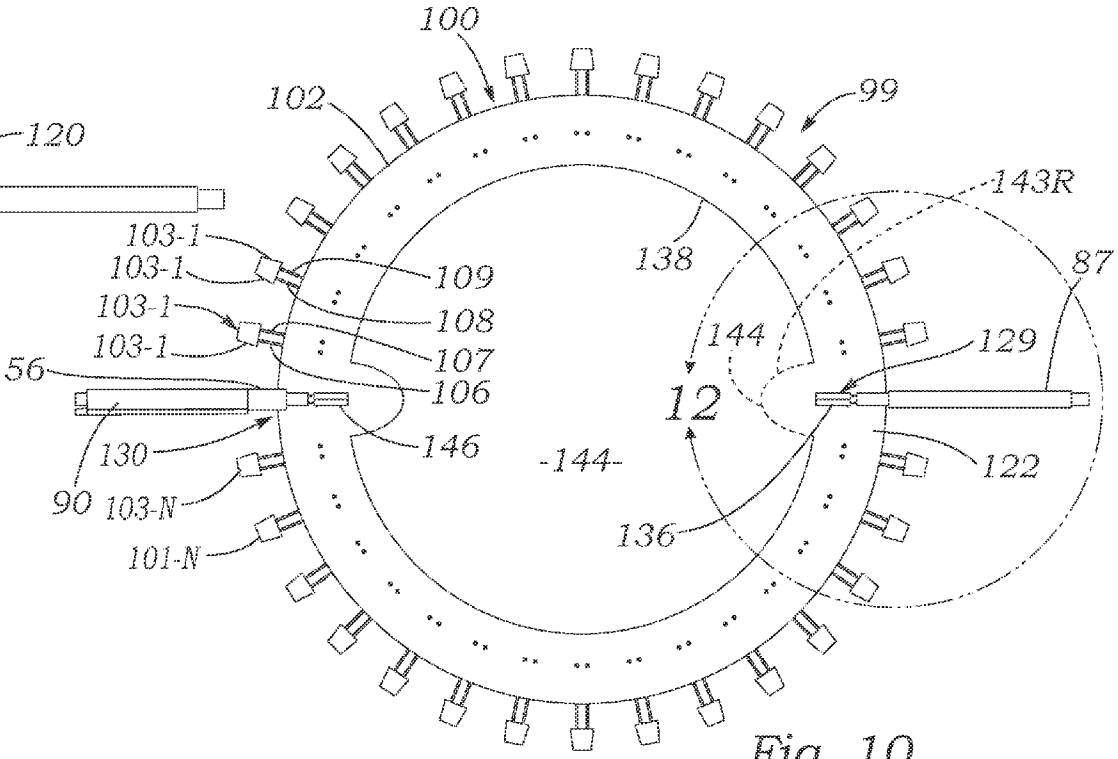
FIG. 10 is fragmentary view of the mirror frame assembly of FIGS. 8 and 9, showing an LED ring illuminator component of the mirror frame assembly.
Figure 12:
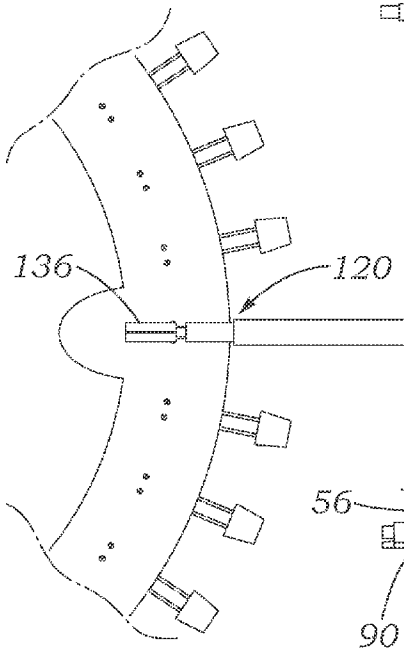
FIG. 12 is a fragmentary view of the LED ring of FIG. 10, on an enlarged scale.

As shown in FIG. 10, copper connector tube 136 of rotatable single-conductor connector 129 is disposed radially between the outer circumferential edge 102 and the inner circumferential edge 138 of PCB 100. The single-conductor connector tube 136 is electrically conductively connected, as by a soldered joint, to both the cathode foil 114 of white LED's 101, and the cathode foil 115 of yellow LED's 103.

As shown in the figures, single-conductor connector tube 136 receives within a bore 139 disposed coaxially through the tube an outer end 140 of a solid copper wire conductor 141 which protrudes from a stripped-back end of the insulation jacket 142 of single conductor wire 87. As shown in FIG. 23, single conductor wire 87 is disposed through sleeve 86R, which is disposed through bores 76R, 78R of right-hand transition section 74R and thence through bore 89R of right-hand bushing 79R into the interior space 89 of mirror assembly 61.

Solid copper wire conductor 141 is of an appropriate size to be received in a loose interference fit within the bore 139 of single-conductor connector tube 136, which enables free rotation of the connector tube and PCB 100 relative to the fixed conductor. Bore 139 of connector tube 136 is sufficiently long to make the contact area between the inner wall surface of the connector tube and the outer surface of outer end 140 of conductor 141 large enough to result in a small electrical resistance of less than 1 ohm between the connector tube and the conductor.

As shown in FIG. 10, PCB 100 optionally and preferably has a tab 143R which extends radially inwardly from the inner circumferential edge 138 of the PCB and into the central aperture 144 through the PCB. The tab 143R has generally the shape of an isosceles triangle which has a convex, arcuately truncated vertex 144 and an altitude collinear with a diameter of the PCB aligned with the longitudinal axis of connector tube 136. Tab 143R enables connector tube 136 to optionally be relocated from the annular region 145 between outer and inner circumferential edges 102 and 138 of PCB 100 to a location between the inner circumferential edge 138 and the vertex 144 of the tab, or to have the connector tube lengthened so that the radially inwardly located transverse of the tube lies on the tab rather than annular region 145.

As shown in FIGS. 10, 13, 14-19 and 22, mirror 30 includes a two-conductor rotatable electrical connector 130 located near outer circumferential edge 102 of PCB 100, at a position diametrically opposed to that of single-conductor connector 129. Two-conductor rotatable electrical connector 130 provides separate electrical paths between anode leads 107 of white LED's 101 and anode leads 109 of yellow LED's 103 through separate switches 133, 134 to positive terminal 135 of d.c. power supply 91.

Referring to FIGS. 10, 13, 14-19 and 22, it may be seen that two-conductor rotatable electrical connector 130 includes a first, center conductor connector tube 146 which is similar in construction and function to connector tube 136 of single-conductor 129. Tube 146 is mounted on the front surface 122 of PCB 100 parallel to that surface, and is disposed radially with respect to the outer circumferential edge 102 and the inner circumferential edge 138 of PCB 100. The longitudinal axis of center conductor tube 146 is axially aligned with the longitudinal axis of single-conductor connector tube 136 located on the opposite edge of PCB 100.

As shown in FIG. 10, center conductor connector tube 146 of two-conductor connector 130 is preferably located radially inwardly from outer circumferential edge 102 of PCB 100 a greater distance than single-conductor connector tube 136, and on a left-hand tab 143L which is a mirror image of right-hand tab 143R.

As shown in the figures, two-conductor center conductor connector tube 146 receives within a bore 149 disposed coaxially through the tube an outer end 150 of a solid copper wire center conductor 151 which protrudes from a stripped-back end of the insulation core 152 of a coaxial cable 90. As shown in FIG. 22, coaxial cable 90 is disposed through sleeve 86L, which is disposed through bores 76L, 78L of left-hand transition section 74L and thence through bore 89L of bushing 79 L into the interior space 89 of mirror assembly 61.

Solid copper wire center conductor 151 is of an appropriate size to be received in a loose interference fit within bore 149 of two-conductor center conductor connector tube 146, which enables free rotation of the connector tube and PCB relative to the fixed conductor. Bore 149 of connector tube 146 is sufficiently long to make the contact area between the inner wall surface of the connector tube and the outer surface of outer end 150 of center conductor 151 large enough to result in a small electrical resistance of less than 1 ohm between the connector tube and the conductor.

The center conductor connector tube 146 of two-conductor connector 130 is electrically connected, as by a soldered joint, to either the anode foil 118 of white LED's 101, or to the anode foil 119 of yellow LED's 103. In the present example, connector tube 146 is connected to anode foil 118 of white LED's 101.

As shown in FIGS. 16-19, two-conductor rotatable electrical connector 130 includes an outer, shield conductor connector tube 156. Outer, shield conductor connector tube 156 of two-conductor connector 130 is similar in construction and function to connector tube 136 of single-conductor connector 129 and center conductor tube 146 of the two-conductor connector. Tube 156 is mounted on the front surface 122 of PCB 100 parallel to that surface, and is disposed radially with respect to the outer circumferential edge 102 and the inner circumferential edge 138 of PCB 100. The longitudinal axis of tube 156 is axially aligned with the longitudinal axes of two-conductor center conductor connector tube 146 and single-conductor connector tube 136 located on the opposite edge of PCB 100.

As shown in FIGS. 10 and 22, outer shield conductor connector tube 156 of two-conductor connector 130 is located radially outwardly from center conductor connector tube 146, and has a larger diameter bore 159.

As shown in the figures, two-conductor outer shield conductor connector tube 156 receives within bore 159 disposed coaxially through the tube an outer exposed conductive shield end 160 of a coaxial cable 90 from which an outer insulating jacket 195 has been stripped. As shown in FIG. 22, coaxial cable 90 is disposed through sleeve 86L, which is disposed through bores 76L, 78L of left-hand transition section 74L and thence through bore 89L of bushing 79L into the interior space 89 of mirror assembly 61. Exposed shield end 160 of coaxial cable 90 is preferably received within the bore 197 of a conductive copper ferrule 196, which is crimped onto the shields.

The outer end of ferrule 196 crimped onto shield conductor end 160 of coaxial cable 90 is of an appropriate size to be received in a loose interference fit within bore 159 of two-conductor outer shield conductor connector tube 156, which enables free rotation of the connector tube and PCB relative to the outer shield conductor of the coaxial cable. The copper ferrule 196 has a smooth outer surface which has a lower coefficient of friction in rotatable contact with bore 159 of outer shield conductor tube 156 than that of a braided exposed coaxial cable shield 160.

Bore 159 of outer shield conductor connector tube 156 is sufficiently long to make the contact area between the inner wall surface of the connector tube and the outer surface of ferrule 196 crimped onto outer shield end 160 of coaxial cable 90 large enough to result in a small electrical resistance of less than 1 ohm between the connector tube and the shield conductor. The outer shield conductor connector tube 156 of two-conductor connector 130 is electrically connected, as by a soldered joint, to either the anode foil 118 of white LED's 101, or to the anode foil 119 of yellow LED's 103. In the present example, connector tube 156 is connected to anode foil 119 of yellow LED's 103.

Figure 24:
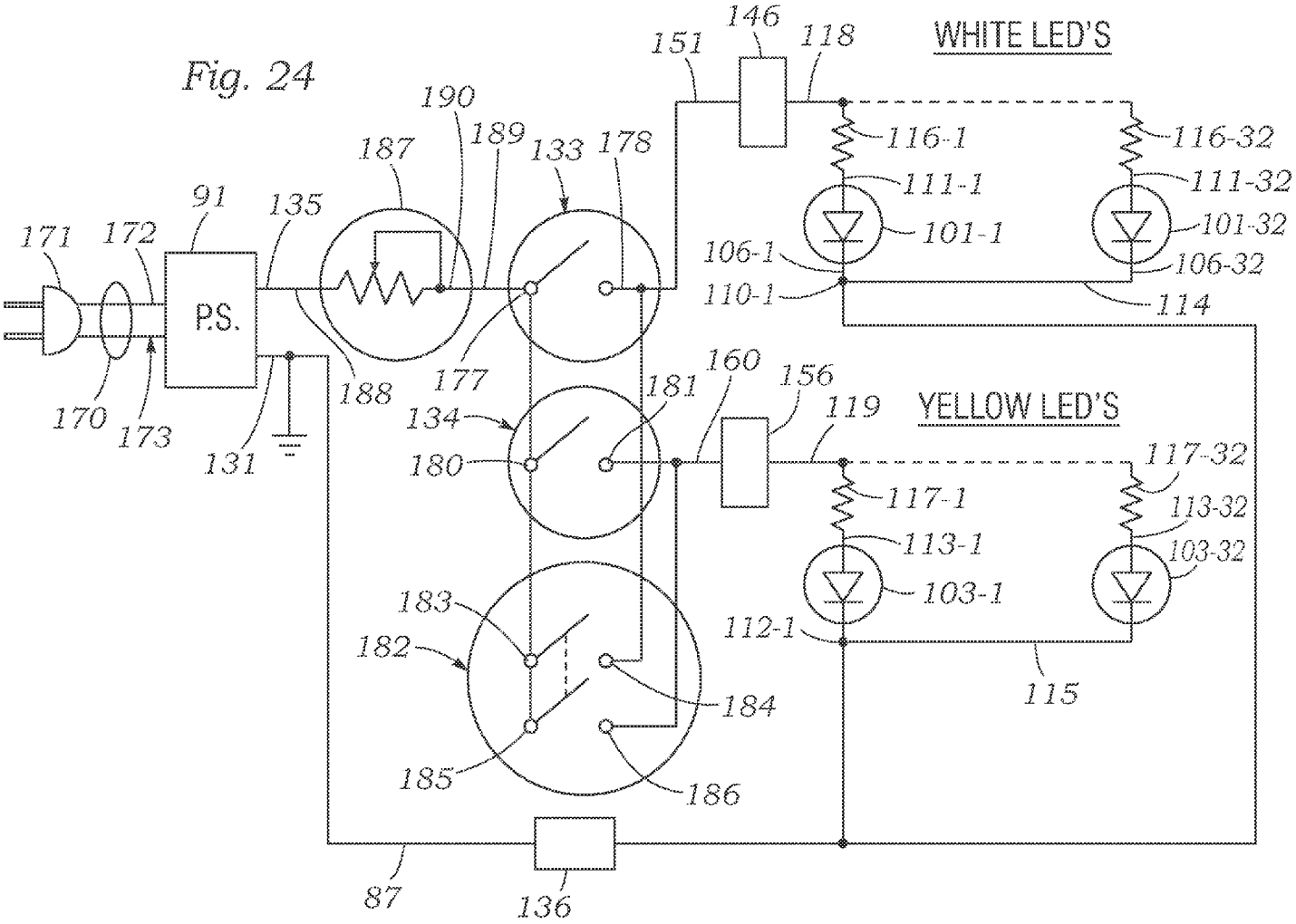
FIG. 24 is an electrical schematic diagram of the mirror of FIG. 1.

FIG. 24 is an electrical schematic diagram of mirror 30 which illustrates how both color temperature and brightness of light emitted from internal illuminator 99 in mirror frame assembly 61 and onto an object such as the face of a person in front of either 1X mirror plate 72 or 5X mirror plate 73 may be adjusted by a user.

As shown in FIG. 24, mirror 30 includes a power cord 170 which terminated at an outer end thereof by an electrical power plug 171 which is insertable into a power mains receptacle. The inner end of power cord 170 is connected to a.c. input terminals 172, 173 of d.c. power supply 91.

As is also shown in FIG. 24, power supply 91 has a negative-voltage output terminal 131 and a positive-voltage output terminal 135. As shown in FIGS. 1 and 24, mirror 30 includes three rocker switches located in base section 31 of the mirror. The three switches include a first single-pole, single-throw (SPST) switch 133 which is used to provide current to white LED's 101 of mirror illuminator 99. Switch 133 has an input contact terminal 177 and an output contact terminal 178.

Mirror 30 also includes a second SPST switch 134 which is used to provide electrical current to yellow LED's 103 of illuminator 99. Switch 134 has an input terminal 180 and an output terminal 181.

As shown in FIGS. 14 and 24, mirror 30 also has a third switch 182. Switch 182 is a double-pole, single-throw (DPST) switch, and is used to provide electrical current simultaneously to both white LED's 101 and yellow LED's 103. The DPST switch has a first contact pair connected to input terminal 183 and output terminal 184, and a second contact pair connected to an input terminal 185 and output terminal 186.

Referring still to FIGS. 1 and 24, it may be seen that mirror 30 includes a variable resistor or potentiometer 187 for adjusting the current in LED's 101, 103 to thus vary the intensity of light emitted by the LED's. As shown in FIG. 24, potentiometer 187 has a first end terminal 188 which is connected to the positive voltage output terminal 135 of power supply 91. Potentiometer 187 also has a contact arm terminal 189 and a second end terminal 190 which are connected to each other and to the input terminals 177, 180, 183 and 185 of switches 133, 134, and 182

As shown in FIG. 24, the negative output terminal 131 of power supply 91 is connected through single-conductor insulated electrical wire 87 and connector tube 136 of single-conductor rotatable connector 129 to the cathode foil 114 of white LED's 101 and the cathode foil 115 of yellow LED's 103 on PCB 100.

As is also shown in FIG. 24, the switched output terminal 178 of white LED switch 133 is connected through the solid copper wire center conductor 151 of coaxial cable 90 and center conductor connector tube 146 of two-conductor rotatable connector 130 to the anode foil 118 of white LED's 101 on PCB 100. Consequently, when first switch 133 is toggled from an open to a closed configuration, current from power supply 91 is conducted through white LED's 101, at a magnitude which is adjustable by turning the control knob 191 of potentiometer 187.

As may be understood by referring to FIG. 24, current can be conducted through white LED's 101 even if switch 133 is an open configuration, if DPST switch 182 is closed, that current being conducted through contacts connected to terminals 183, 184 of switch 182.

As is also shown in FIG. 24, the switched output terminal 181 of yellow LED switch 134 is connected through the outer shield conductor 160 of coaxial cable 90 and through outer conductor connector tube 156 of two-conductor rotatable connector 130 to the anode foil 119 of yellow LED's 103 on PCB 100. Consequently, when second switch 134 is toggled from an open to a closed configuration, current from power supply 91 is conducted through yellow LED's 103, at a magnitude which is adjustable by turning the control knob 191 of potentiometer 187.

As may be understood by referring to FIG. 24, current can be conducted through yellow LED's 103 even if switch 134 is an open configuration, if DPST switch 182 is closed, that current being conducted through contacts connected to terminals 185, 186 of switch 182.

As may also be understood by referring to FIG. 24, when DPST switch 182 is closed, d.c. current adjustable in magnitude by turning control knob 191 of potentiometer 187 is conducted through both white LED's 101 and yellow LED's 103 of illuminator 99.

In a preferred embodiment, switches 133,134 and 182, and potentiometer 187, are touch-sensitive controls. Also, potentiometer 187 may optionally be replaced by a pulse-width-modulated (PWM) intensity control circuit which varies the duty cycle of pulses of current used to energize LED's 101 and 103 at a frequency above that frequency perceivable as a flicker by a human.

Optionally, separate potentiometers or PWM intensity controls could be provided for white LED's 101 and yellow LED's 103, thus enabling additional adjustability of the color temperature of light emitted by the illuminator 99.

Also, mirror 30 could be modified by adding LED's of a third type to the illuminator 99, and replacing the single conductor rotatable connector by a second two-conductor rotatable connector similar in construction and function to those of rotatable two-conductor connector 130.

Optionally, individual pairs or trios of LED's having different color temperatures may be replaced by single dual-color LED's or triple-color LED's contained in three-terminal or four-terminal packages, respectively.

According to another modification of the mirror 30, the electrically conductive path between the base, stanchion, yoke support tube, yoke, bushings, and mirror frame could be used to eliminate one rotatable PCB-mounted connector, since the LED's are powered by safe, low voltages, typically less than 12 volts.

What is claimed is:

1. A mirror comprising;

a. a mirror assembly including a mirror frame holding therein at least a first imaging reflective mirror plate, said first reflective mirror plate having an axially outwardly facing imaging light reflective surface and a light transmissive region adjacent to said light reflective surface;

b. an illuminator located within said frame rearward of said light transmissive region of said first reflective mirror plate for emitting light forward through said mirror plate, said illuminator having at least first and second types of separately selectable electrically energizable light sources;

c. an electrical power coupling mechanism for providing electrical power selectably to either or both of said first and second light sources; and d. a yoke having first and second opposed yoke arms, said yoke arms having at upper ends thereof opposed collinear support bushings for rotatably supporting therebetween said mirror frame, wherein said electrical power coupling mechanism for providing electrical power to said illuminator includes at least a first two-conductor rotatable electrical connector for rotatably connecting first and second electrical power leads disposed through one of said yoke arm bushings separately to first-polarity electrical terminals of said first and second types of light sources, said first two-conductor rotatable electrical connector including;

i. a first, radially inwardly located center conductor connector tube having a longitudinal axis aligned with collinear rotation axes of said mirror frame support bushings, said center conductor connector tube being fixed to said mirror frame and rotatably receiving in rotatable electrically conductive contact the center conductor of a first coaxial cable disposed coaxially through a first one of said bushings, and ii. a second, outer conductor connector tube fixed to said mirror frame and located radially outwardly from and in axial alignment with and spaced longitudinally away from said center conductor connector tube, said outer conductor connector tube rotatably receiving in rotatable electrically conductive contact the outer conductor of said coaxial cable, said center conductor connector and said outer conductor connector tubes being in electrically conductive contact with separate first-polarity terminals of said first and second type light sources.

2. The mirror of claim 1 wherein the color temperatures of said first and second type light sources differ from one another.

3. The mirror of claim 2 wherein said first and second type light sources are further defined as first and second individually energizable LED's of a multi-color LED.

4. The mirror of claim 2 wherein said first and second type light sources are further defined as first and second arrays of first and second type light emitting diodes (LED's) which differ in color temperature from one another.

5. The mirror of claim 4 wherein one of said first and second LED types has a color temperature between 4800K and 6000K and the other of said first and second LED types has a color temperature between 2500K and 3800K.

6. The mirror of claim 1 further including a third type of light source which has a color temperature which differs from the color temperatures of said first and second type light sources.

7. The mirror of claim 6 wherein said first, second and third types of light sources are further defined as first, second and third arrays of first, second and third types of light emitting diodes (LED's) which differ in color temperature from one another.

8. The mirror of claim 7 further including a second two-conductor rotatable electrical connector is disposed through said second, opposite yoke arm bushing opposite said first bushing, said second two-conductor rotatable electrical connector having a first electrical conductor in electrically conductive contact with first-polarity terminals of said third type of LED, and a second electrical conductor in electrically conductive contact with second-polarity, common terminals of said first, second and third light emitting diodes.

9. The mirror of claim 7 further wherein said second two-conductor rotatable electrical connector includes:

a. a third, radially inwardly located connector tube having a longitudinal axis aligned with collinear rotation axes of said mirror frame support bushings, said third, inner connector tube being fixed to said mirror frame and rotatably receiving in rotatable electrically conductive contact the center conductor of a second coaxial cable disposed through a second one of said bushings, said third, inner conductor tube being in electrically conductive contact with second-polarity terminals of said first, second and third types of LED's, and b. a fourth, outer connector tube fixed to said mirror frame and located radially outwardly from and in axial alignment with said third, inner connector tube, said outer connector tube rotatably receiving in rotatable electrically conductive contact the outer conductor of said second coaxial cable, said fourth, outer connector tube being in electrically conductive contact with first-polarity terminals of said third type light emitting diodes.

10. The mirror of claim 7 wherein said first, second and third type LED's are contained in a four-terminal package.

11. The mirror of claim 1 further including a single conductor rotatable electrical connector for rotatably connecting a third electrical power lead to second-polarity terminals of both of said first and second type light sources.

12. The mirror of claim 11 wherein said single conductor rotatable electrical connector is disposed through said second yoke arm bushing opposite said first bushing, said single conductor rotatable electrical connector being in electrically conductive contact with second-polarity common terminals of said first and second type light sources.

13. The mirror of claim 12 wherein said single-conductor rotatable electrical connector is further defined as comprising a third connector tube, located on a side of said frame opposite to and in axial alignment with said first, radially inwardly located connector tube of said two-conductor connector, said third connector tube being in electrically conductive contact with an electrical conductor common to both said first and second type light sources, and receiving in rotatable electrically conductive contact a third electrical power supply conductor.

14. The mirror of claim 13 wherein said third electrical power supply conductor includes a single-conductor electrical wire disposed through said second yoke arm and bushing.

15. The mirror of claim 13 wherein said third electrical power supply conductor includes in combination an electrically conductive part of said yoke arm, an electrically conductive bushing in electrically conductive contact with said bushing, and an electrically conductive part of said frame in electrically conductive contact with said bushing.

16. The mirror of claim 13 further including a yoke support member for supporting said yoke.

17. The mirror of claim 16 further including a stanchion for supporting said yoke support member.

18. The mirror of claim 17 wherein said yoke support member includes a rotatable joint which enables pivotable movement of said yoke relative to said stanchion.

19. The mirror of claim 17 further including a base which supports a lower end of said stanchion.

20. The mirror of claim 19 further including an electrical power supply for powering said illuminator, said power supply being located within said base of said mirror.

21. The mirror of claim 20 wherein said power supply includes a first-polarity output terminal separately connectable to said inner and outer conductors of said coaxial cable, and a second-polarity, common output terminal connected to said third electrical power supply conductor.

22. The mirror of claim 21 further including a selector switch connectable in series with said first output terminal of said power supply and proximal ends of said inner and outer conductors of said coaxial cable, said selector switch enabling connection of either or both said inner and outer coaxial cable conductors to said first-polarity output terminal of said power supply.

23. The mirror of claim 22 further including an electrical mechanism for selectably varying the current supplied by said power supply to at least one of said inner and outer conductors of said coaxial cable.

24. The mirror of claim 22 wherein said stanchion disposed between said base and said yoke is further defined as having a hollow passageway through its length.

25. The mirror of claim 24 wherein said electrical conductors for conducting electrical power to said yoke arm connectors are further defined as comprising first and second conductors disposed through said hollow passageway of said stanchion and said first and second yoke arms, respectively.

26. The mirror of claim 25 wherein said first and second type light sources are further defined as being LED's of different color temperatures.

27. The mirror of claim 26 wherein said first and second LED's are contained in a three-terminal package.

28. A mirror comprising:

a. a mirror assembly including a mirror frame holding therein at least a first imaging light reflective mirror plate, said first reflective mirror plate having a central outwardly facing imaging reflective surface and at least one light transmissive region adjacent to said imaging reflective surface;

b. an electrically energizable illumination source located within said frame inwardly of an inner facing side of said reflective mirror plate, said illumination source having light emitting regions effective in directing light rays through said light transmissive regions of said first reflective mirror plate;

c. a yoke having opposed first and second yoke arms for rotatably supporting therebetween said mirror frame;

d. an electrical power coupling mechanism for providing electrical power to said illumination source, said electrical power coupling mechanism including a pair of laterally opposed continuously rotatable electrically connectors;

e. a support base containing therein an electrical power supply; and f. a support structure disposed between said base and said yoke, said support structure having disposed therein hollow tubular passageways for receiving therethrough a first electrical conductor through said first yoke arm and a second electrical conductor through said second yoke arm, said first and second conductors being electrically conductively connectable to first and second output terminals of said power supply, said support structure including i. a stanchion which protrudes upwardly of said base and ii. a yoke support member including a rotatable joint at an upper end of said stanchion for pivotably supporting said yoke, said light emitting regions of said illumination source being at least in part aligned with said light transmissive region of said first reflective mirror plate.

29. The mirror of claim 28 wherein said light transmissive region of said first reflective mirror plate is further defined as having generally the shape of an annular ring-shaped band which circumscribes said imaging reflective surface of said first reflective mirror plate.

30. The mirror of claim 29 wherein said light emitting regions of said illumination source are further defined as lying on a transversely disposed annular ring-shaped band on a support member, said band being concentric with said light transmissive region of said first reflective mirror plate and located axially inwards of said first reflective mirror plate.

31. The mirror of claim 30 wherein said light emitting regions of said illumination source are further defined as being located in a plurality of light emitting diodes arranged in circumferentially spaced apart locations adjacent to an outer peripheral edge of said ring-shaped band.

32. The mirror of claim 30 wherein said support member is further defined as including a ring-shaped printed circuit board on which are mounted said plurality of light emitting diodes, said light emitting diodes emitting light of a first color temperature when first type LED's thereof are electrically energized and light of a third color when both said first type and second type LED's are energized.

33. The mirror of claim 32 further including a second reflective mirror plate having a central outwardly facing imaging reflective surface and a light transmissive region adjacent to said imaging reflective surface, said second reflective mirror plate having an inner surface which confronts the inner surface of said first reflecting mirror plate.

* * * * *